US010599095B2

(12) United States Patent
Takahashi et al.

(10) Patent No.: US 10,599,095 B2
(45) Date of Patent: Mar. 24, 2020

(54) IMAGE FORMING APPARATUS

(71) Applicant: CANON KABUSHIKI KAISHA, Tokyo (JP)

(72) Inventors: Kyosuke Takahashi, Toride (JP); Hideki Fujita, Moriya (JP); Akihiro Noguchi, Toride (JP); Mitsuhiro Furukawa, Chofu (JP); Kosuke Takeuchi, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/029,986

(22) Filed: Jul. 9, 2018

(65) Prior Publication Data

US 2019/0011877 A1 Jan. 10, 2019

(30) Foreign Application Priority Data

Jul. 10, 2017 (JP) ..... 2017-134891

(51) Int. Cl.
*G03G 15/20* (2006.01)
*G03G 21/20* (2006.01)
*G03G 15/08* (2006.01)

(52) U.S. Cl.
CPC ..... *G03G 21/20* (2013.01); *G03G 15/0887* (2013.01); *G03G 15/0893* (2013.01)

(58) Field of Classification Search
CPC ..... G03G 15/0865; G03G 15/0887; G03G 15/556; G03G 15/0877; G03G 15/0856; G03G 15/0891; G03G 15/0868
See application file for complete search history.

(56) References Cited

U.S. PATENT DOCUMENTS

| | | | | |
|---|---|---|---|---|
| 7,881,638 | B2 | 2/2011 | Noguchi et al. | |
| 9,563,150 | B2 | 2/2017 | Takahashi et al. | |
| 9,952,536 | B2 | 4/2018 | Takahashi et al. | |
| 2012/0070165 | A1* | 3/2012 | Suzuki | G03G 15/556 399/27 |
| 2016/0170327 | A1* | 6/2016 | Saito | G03G 15/0856 399/27 |
| 2017/0068183 | A1 | 3/2017 | Matsumoto et al. | |
| 2017/0115602 | A1 | 4/2017 | Matsumoto et al. | |

FOREIGN PATENT DOCUMENTS

| | | | |
|---|---|---|---|
| JP | 2001-343826 | A | 12/2001 |
| JP | 2010-002551 | A | 1/2010 |
| JP | 2010-262080 | A | 11/2010 |

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes a controller to control a driving device such that a rotational speed of a supplying and feeding screw when it is rotated a predetermined number of times to supply developer to a developing device in a predetermined amount during execution of a continuous image forming job on a plurality of first recording materials is a first rotational speed, and a rotational speed of the supplying and feeding screw when it is rotated the predetermined number of times to supply the developer in the predetermined amount during execution of a continuous image forming job on a plurality of second recording materials is a second rotational speed slower than the first rotational speed. The second recording materials have a length longer than the first recording materials with respect to a sub-scan direction.

20 Claims, 18 Drawing Sheets

(a)

(b)

(a)

(b)

(a)

(b)

IMAGE FORMING APPARATUS

FIELD OF THE INVENTION AND RELATED ART

The present invention relates to an image forming apparatus of an electrophotographic type, an electrostatic recording type or the like, in which an image is formed on a recording material.

Conventionally, the image forming apparatus of the electrophotographic type has been widely used as a copying machine, a printer, a plotter, a facsimile machine, a multifunction machine having a plurality of functions of these machines, or the like. In the image forming apparatus of this type, one in which an electrostatic latent image formed on a photosensitive drum is developed with a two-component developer principally containing non-magnetic toner and a magnetic carrier has become widespread. The toner with which the electrostatic latent image is formed on the photosensitive drum is supplied to a developing device by using a toner bottle or a hopper. In a constitution in which a toner supplying developer container is incorporated in the hopper, when the toner in the developing device is consumed in image formation, the toner is supplied from the toner bottle to the developing device by rotation of the toner bottle.

In the case of the two-component developing device, a toner charge amount changes depending on a ratio between the toner and the carrier, and therefore, it is desirable that a difference between a target supply amount and an actual supply amount is small so that the ratio between the toner and the carrier falls within a predetermined range. In order to make the difference between the target supply amount and the actual supply amount small, an image forming apparatus in which the number of times of rotation of the supplying screw is detectable and the toner is supplied by rotating the supplying screw a calculated number of times of rotation has been proposed (Japanese Laid-Open Patent Application (JP-A) 2001-343826). According to this image forming apparatus, the difference between the target supply amount and the actual supply amount can be made small. As regards a rotational speed of the supplying screw, the rotational speed is made constant to the extent possible in a steady-state suppliable range so that the toner can be quickly supplied even in the case where whole surface printing is continuously carried out.

However, in the image forming apparatus disclosed in JP-A 2001-343826, the supplying screw rotates at a certain high speed, and therefore, there is a liability that a degree of stirring of the supplied toner is insufficient.

SUMMARY OF THE INVENTION

A principal object of the present invention is to provide an image forming apparatus in which a supplying screw for supplying toner from a toner supplying device to a developing device is provided and which is capable of improving a stirring property of supplied toner.

According to an aspect of the present invention, there is provided an image forming apparatus comprising: an image bearing member; a developing device including a developer container accommodating a developer containing toner and a carrier, a feeding member configured to feed the developer, and a developer carrying member configured to carry and feed the developer; a toner supplying portion including a feeding screw configured to feed the toner to be supplied to the developing device, a driving source configured to rotationally drive the feeding screw, and a controller configured to control drive of the feeding screw, wherein in the toner supplying portion, a first integer of times of rotation of the feeding screw in a predetermined period is a maximum integer and is set in advance, and wherein an amount of the toner to be supplied to the developing device is controlled by an integer of times of rotation of the feeding screw in the predetermined period; and a supply rotation number determining portion configured to determine a number of times of rotation of the feeding screw for supplying the toner to the developing device, depending on an image signal, wherein the controller controls the driving portion so that the feeding screw is rotated at a first rotational speed when the supply rotation number determining portion determines the number of times of the rotation at the first integer of times of rotation and so that the feeding screw is rotated at a second rotational speed slower than the first rotational speed when the supply rotation number determining portion determines the number of times of the rotation at a second integer of times of rotation smaller than the first integer of times of rotation.

Further features of the present invention will become apparent from the following description of exemplary embodiments with reference to the attached drawings.

Figure 5:
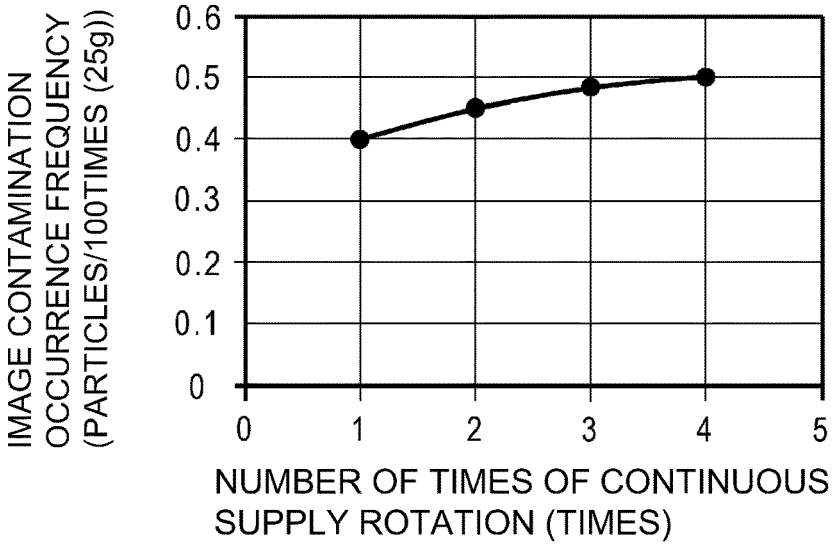
Figure 5:
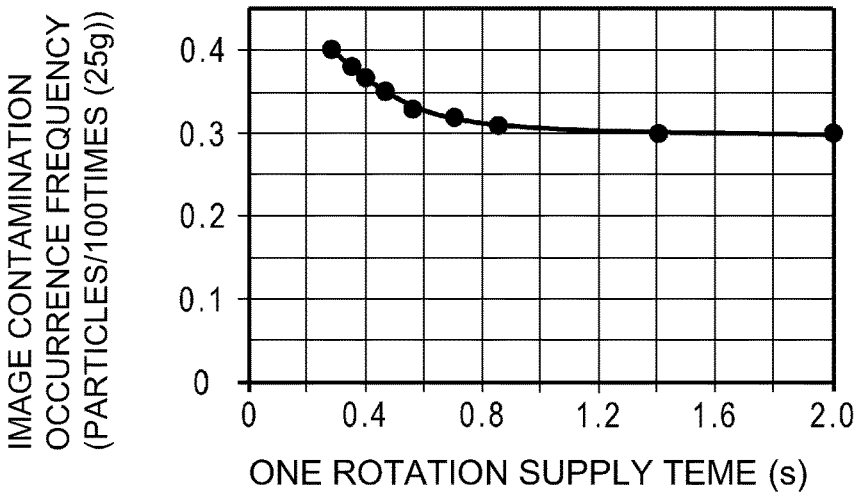

Part (a) of FIG. 5 is a graph showing a relationship between the number of times of continuous supply rotation and an image contamination occurrence frequency in the developing device of the image forming apparatus in the First Embodiment, and part (b) of FIG. 5 is a graph showing a relationship between a one rotation supply time and the image contamination occurrence frequency in the developing device of the image forming apparatus in the First Embodiment.

Figure 6:
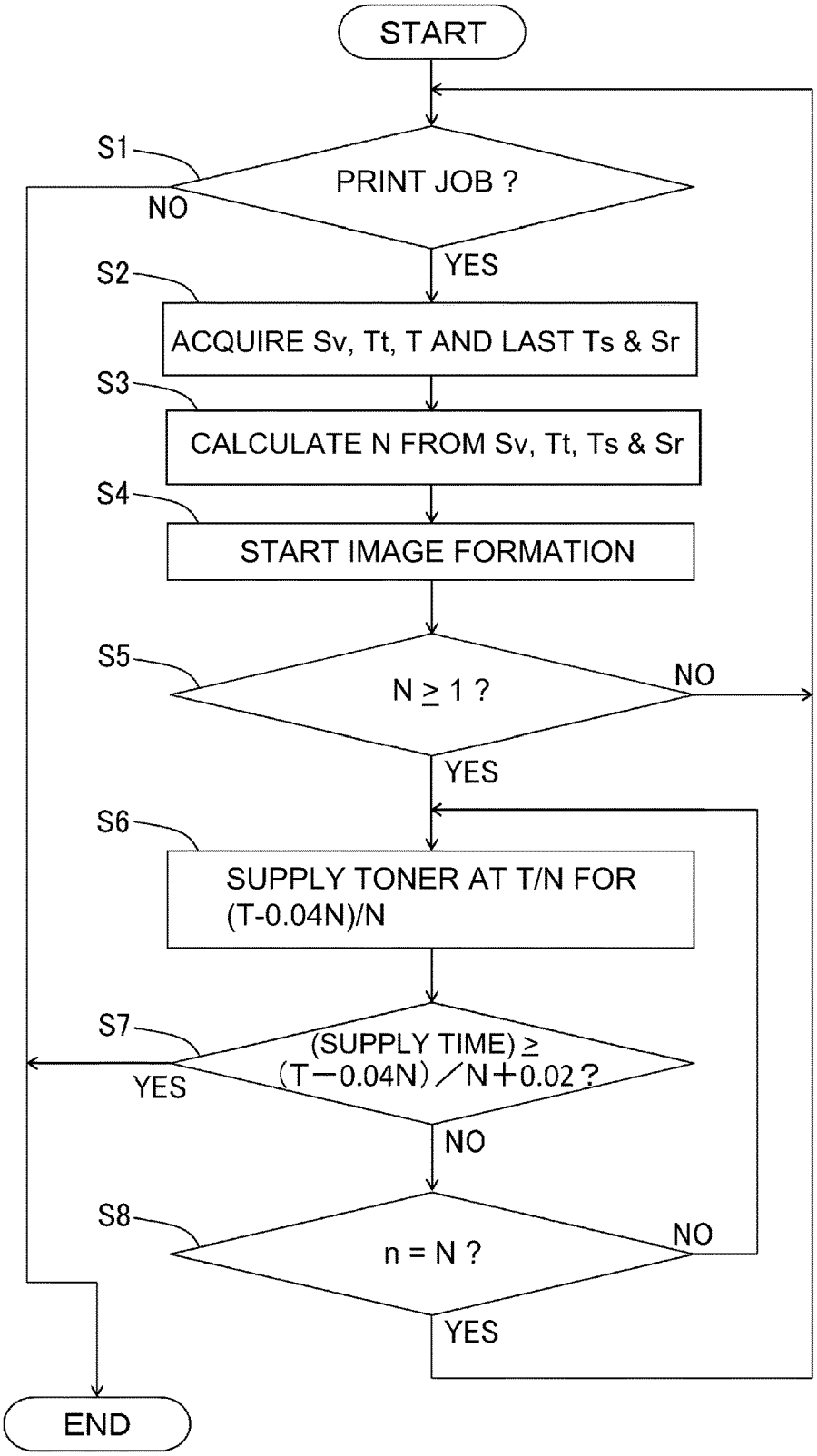

FIG. 6 is a flowchart showing a procedure when toner is supplied to a developer container in the image forming apparatus in the First Embodiment.

Figure 7:
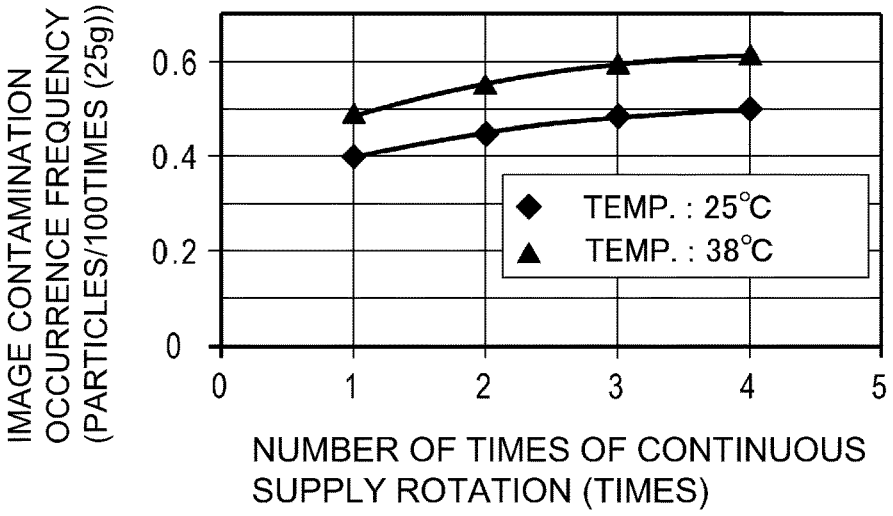
Figure 7:
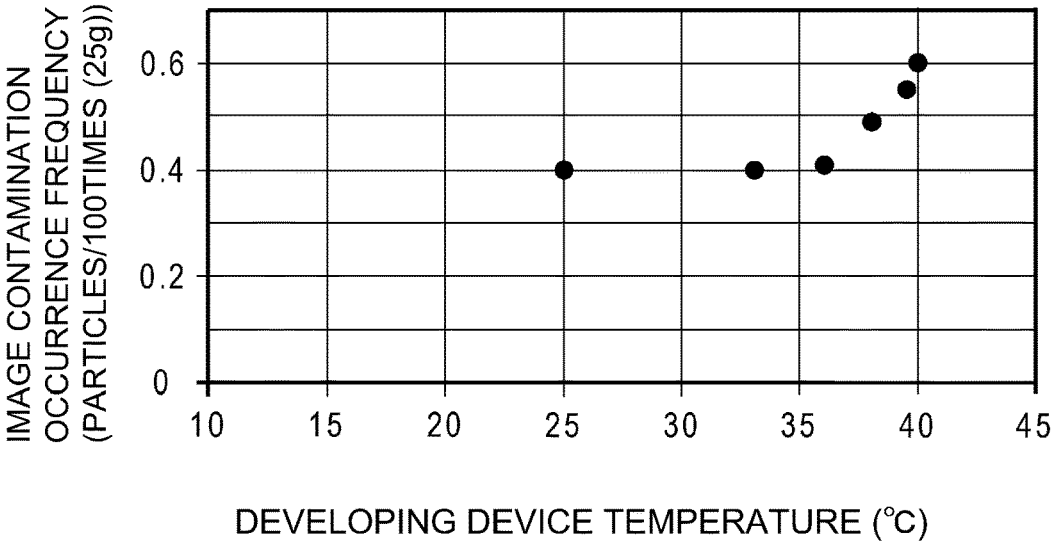

Part (a) of FIG. 7 is a graph showing a relationship among the number of times of continuous supply rotation, an image contamination occurrence frequency and a developing device temperature in a developing device of an image forming apparatus according to a Second Embodiment, and part (b) of FIG. 5 is a graph showing a relationship between the developing device temperature and the image contamination occurrence frequency in the developing device of the image forming apparatus in the Second Embodiment.

Figure 8:
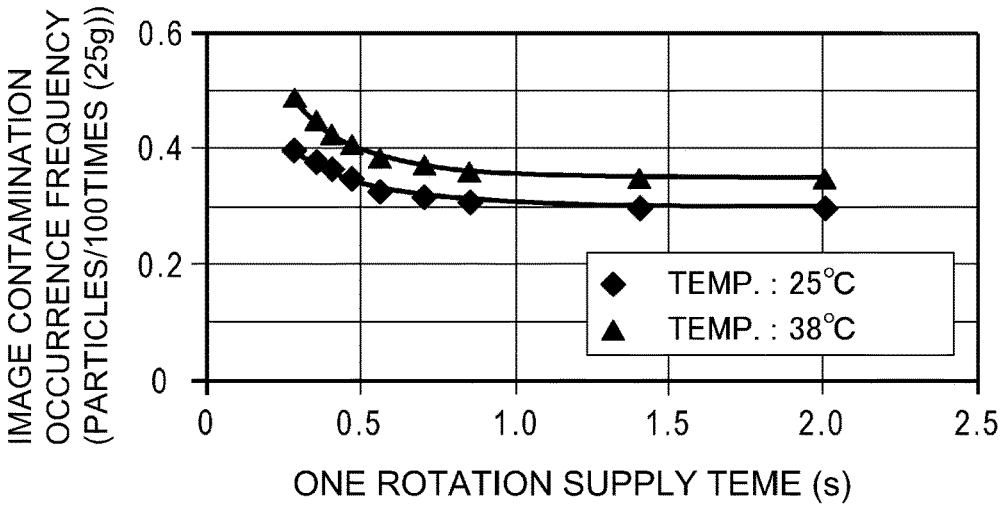
Figure 8:
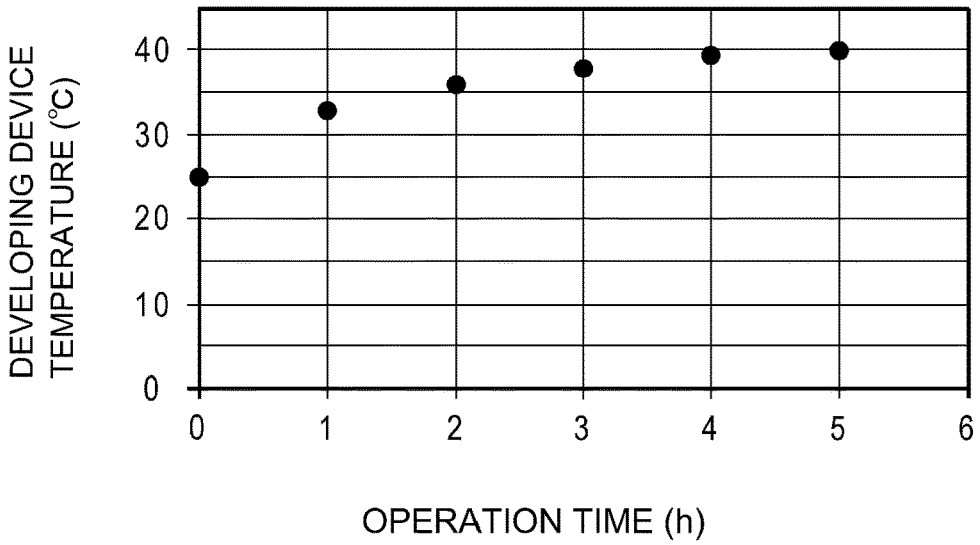

Part (a) of FIG. 8 is a graph showing a relationship among one rotation supply time, the image contamination occurrence frequency and the developing device threshold in the developing device of the image forming apparatus in the Second Embodiment, and part (b) of FIG. 8 is a graph showing a relationship between an operation time and the developing device temperature in the developing device of the image forming apparatus in the Second Embodiment.

Figure 9:
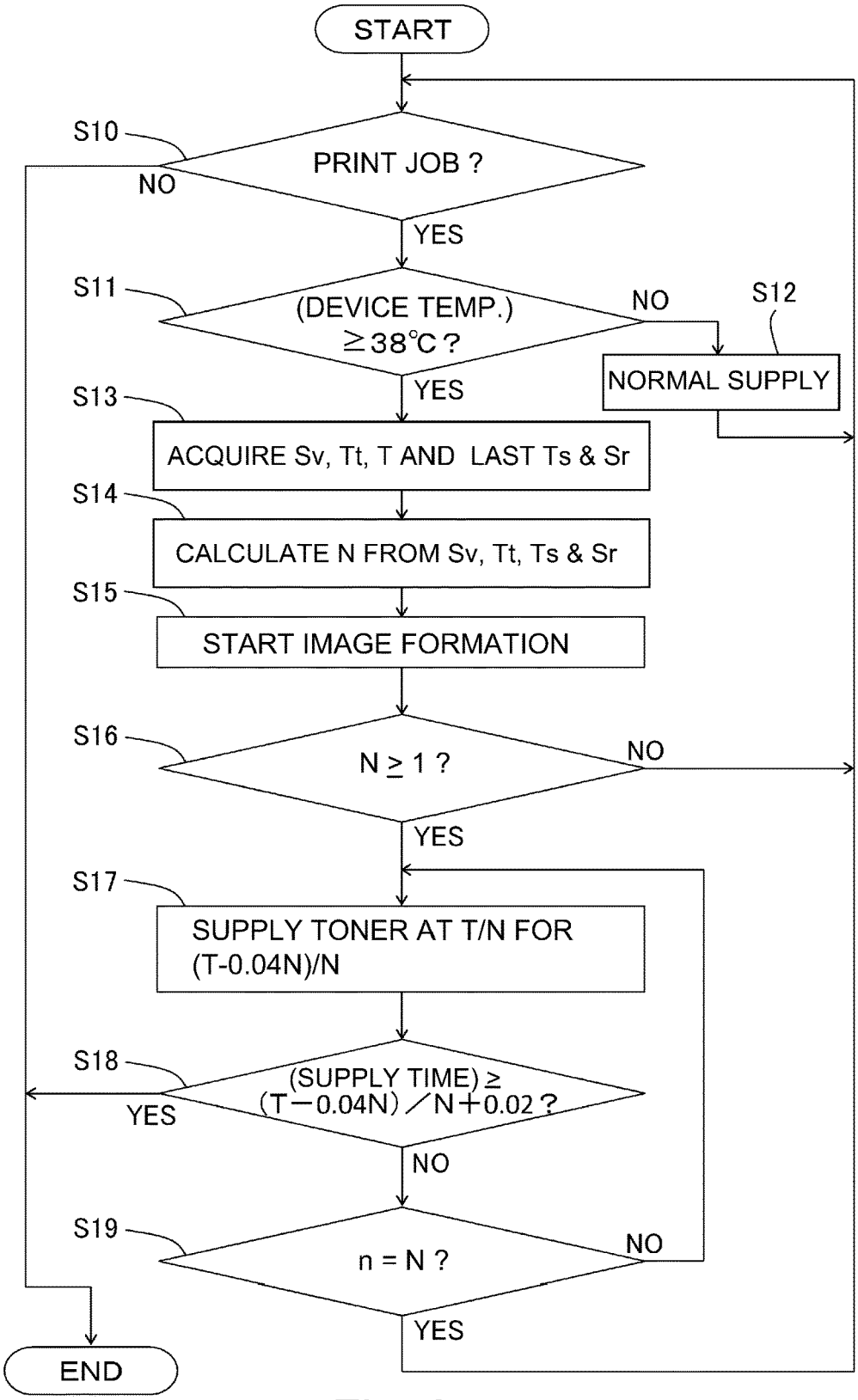

FIG. 9 is a flowchart showing a procedure when toner is supplied to a developer container in the image forming apparatus in the Second Embodiment.

Figure 10:
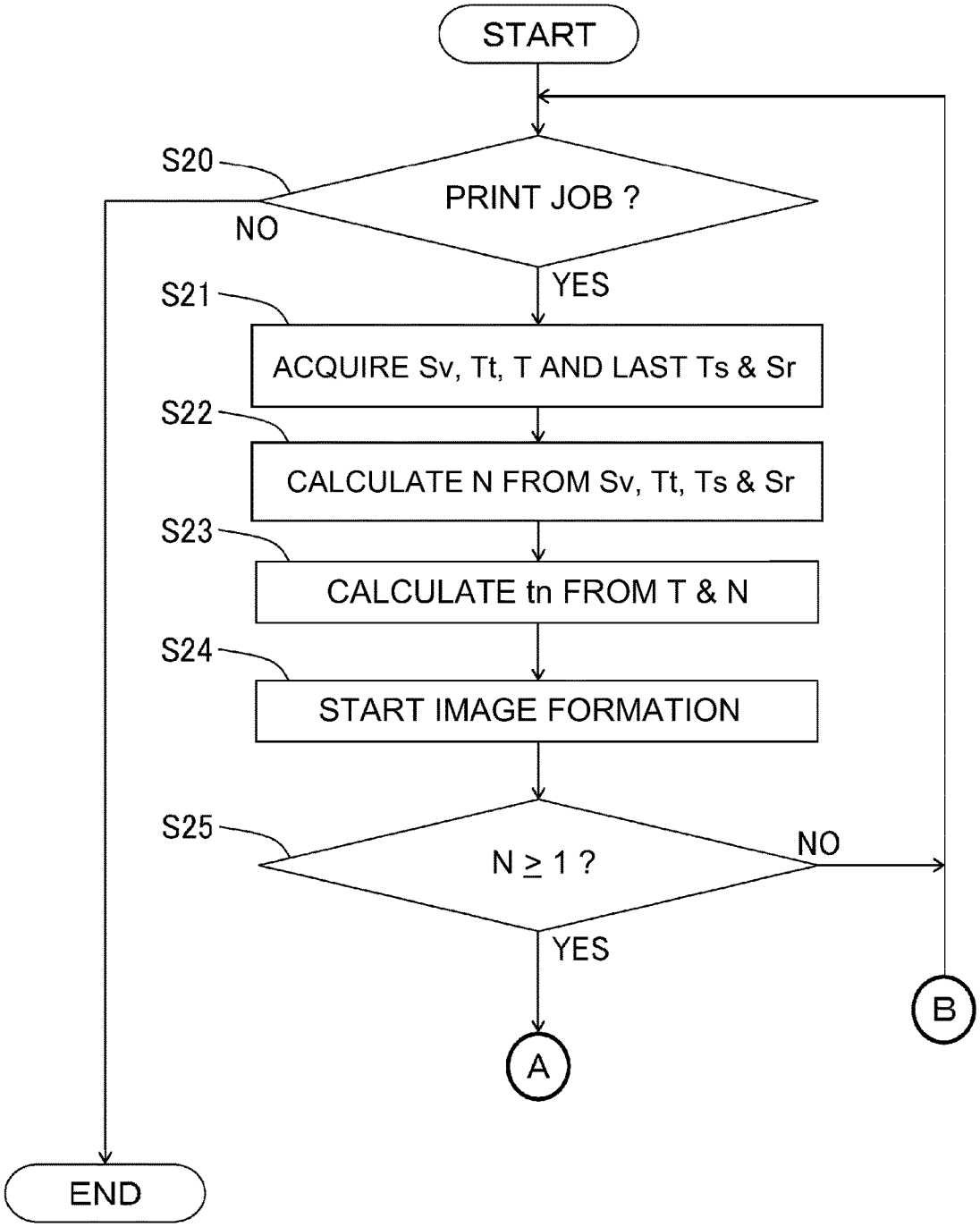

FIG. 10 is a first half of a flowchart showing a procedure when toner is supplied to a developer container in an image forming apparatus according to a Third Embodiment.

Figure 11:
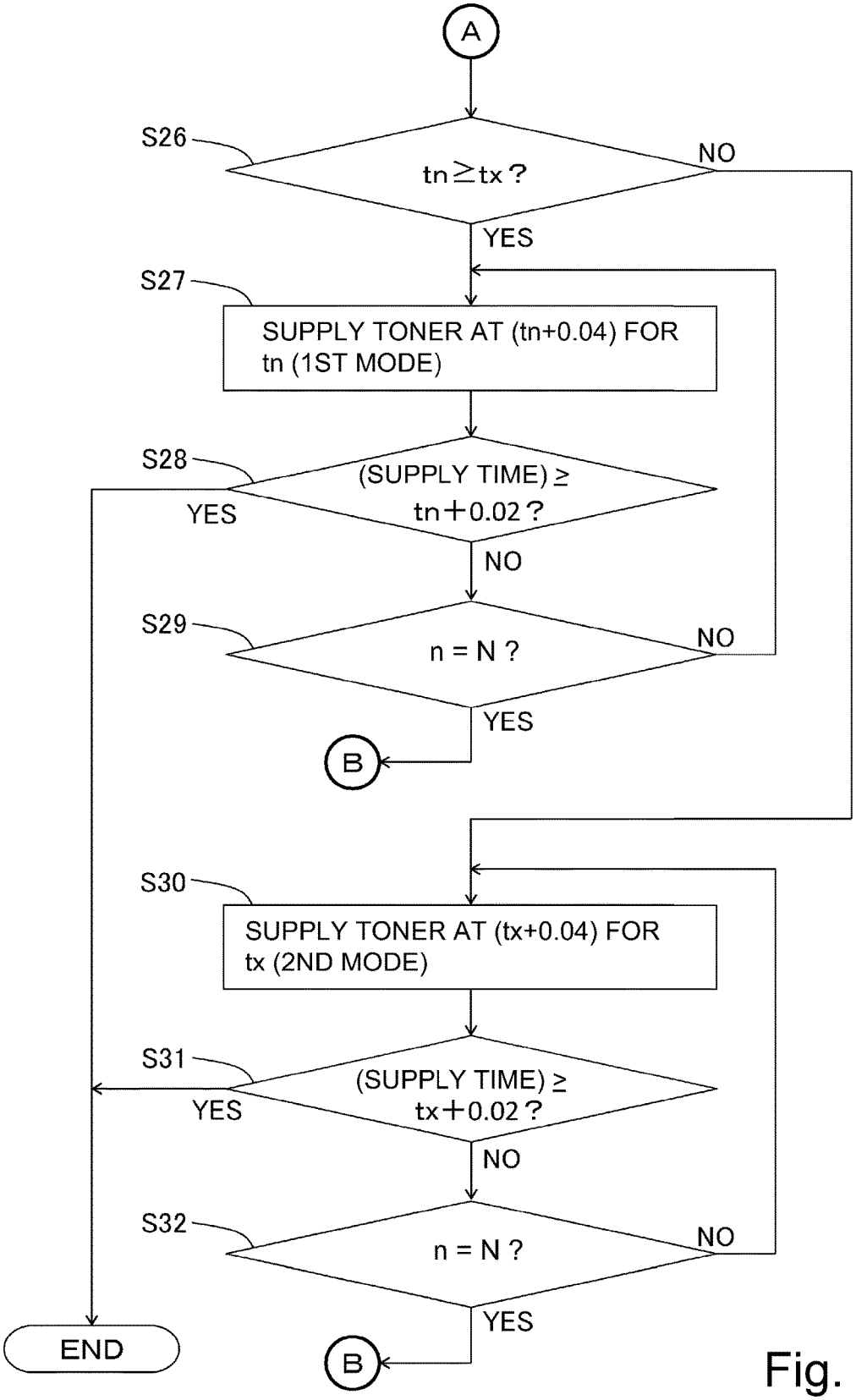

FIG. 11 is a second half of a flowchart showing the procedure when the toner is supplied to the developer container in the image forming apparatus in the Third Embodiment.

Figure 12:
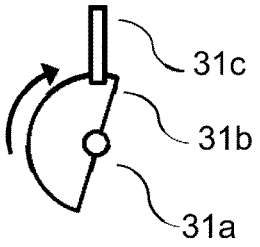

FIG. 12 is a sectional view showing a rotation detecting means of a toner supply motor in an image forming apparatus according to a Fourth Embodiment.

Figure 13:
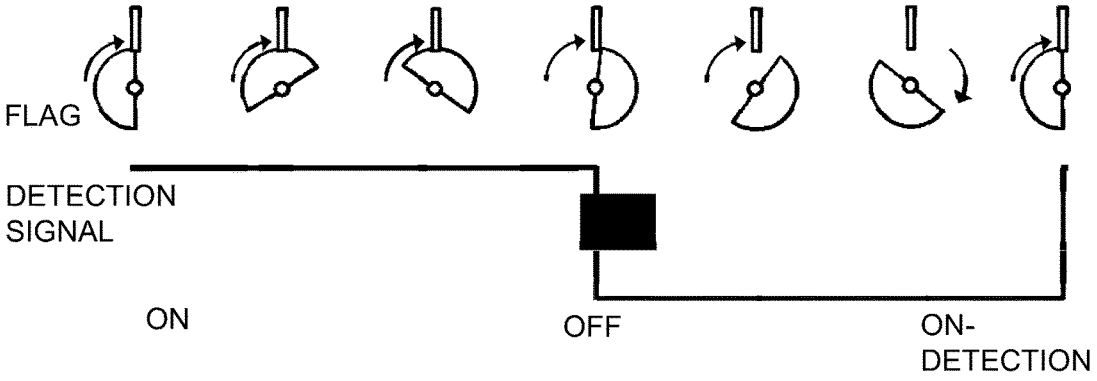

FIG. 13 is a schematic view showing rotation of the toner supply motor and time progression of a detection result in the image forming apparatus in the Fourth Embodiment.

Figure 14:
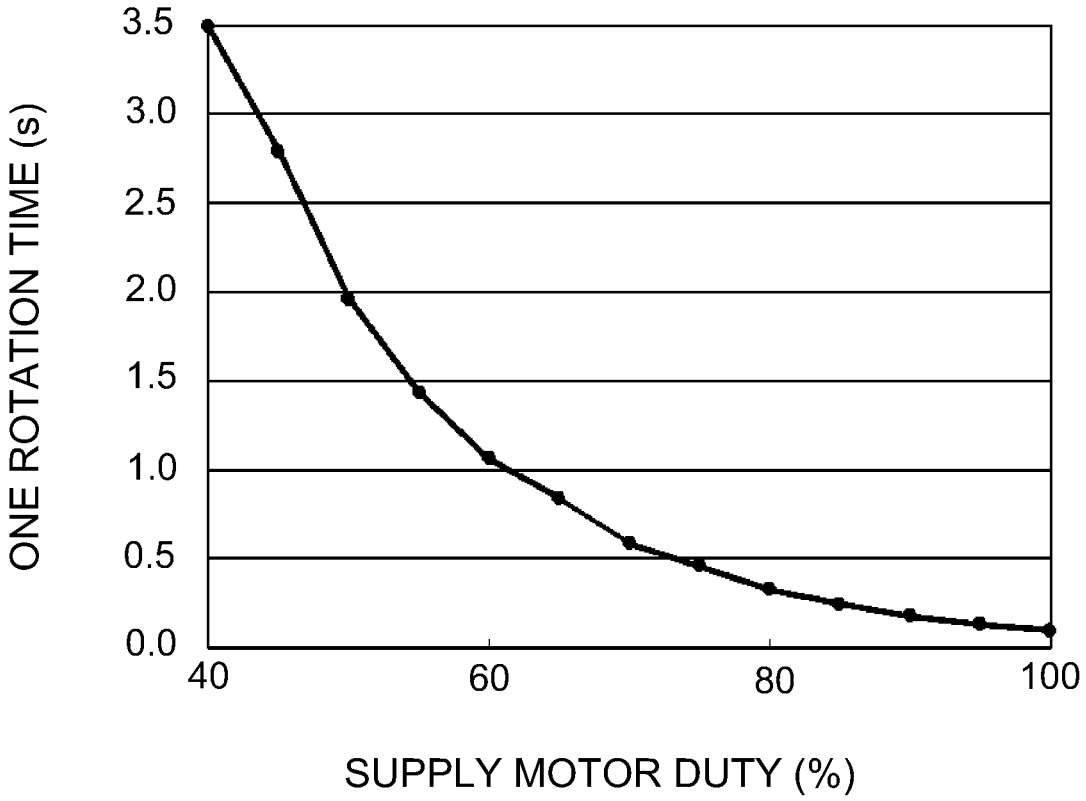

FIG. 14 is a graph showing a relationship between an input value of the toner supply motor and one rotation detection time in the image forming apparatus in the Fourth Embodiment.

Figure 15:
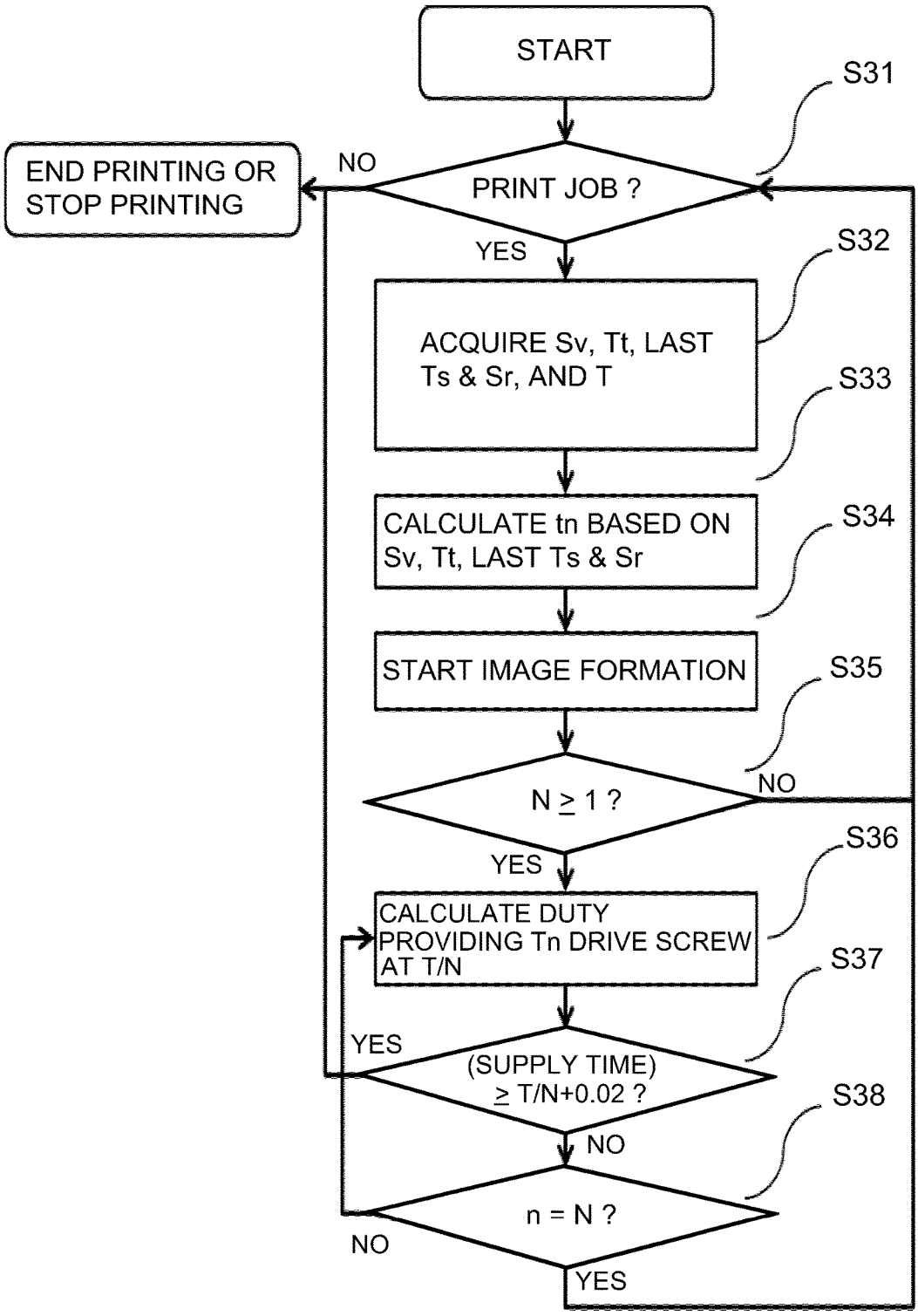

FIG. 15 is a flowchart showing a procedure when toner is supplied to a developer container in the image forming apparatus in the Fourth Embodiment.

Figure 16:
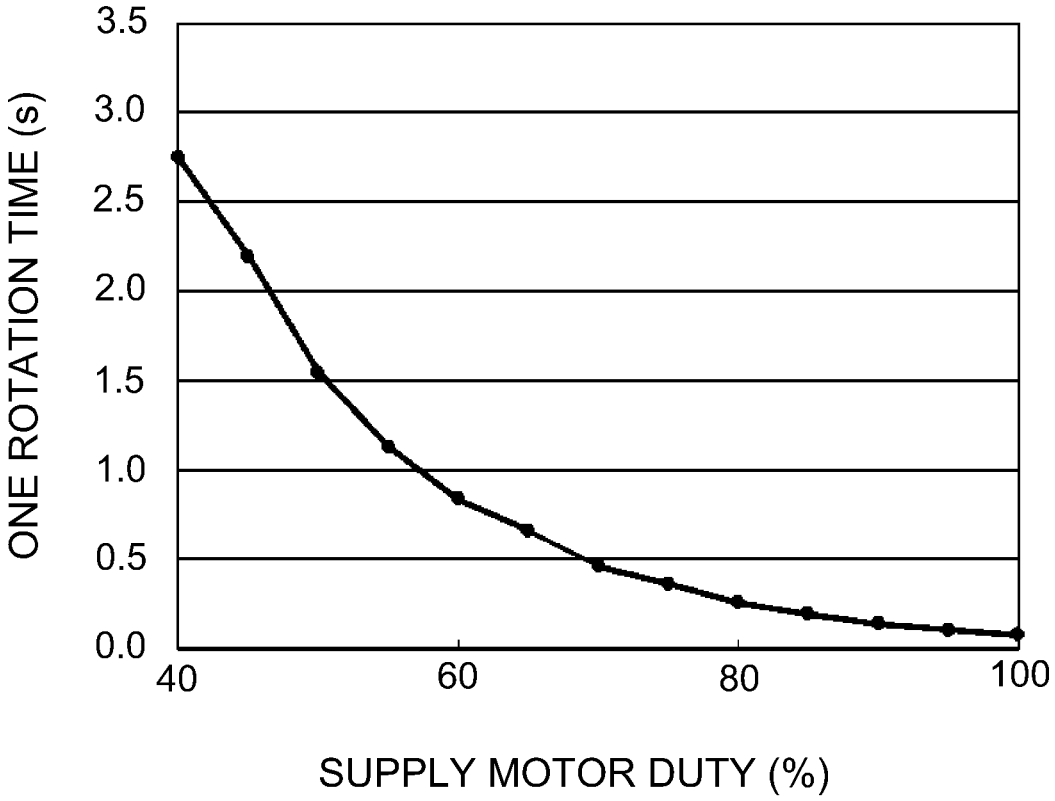

FIG. 16 is a graph showing a relationship between an input signal of a toner supply motor and one rotation detection time in a toner absence state in an image forming apparatus according to a Fifth Embodiment.

Figure 17:
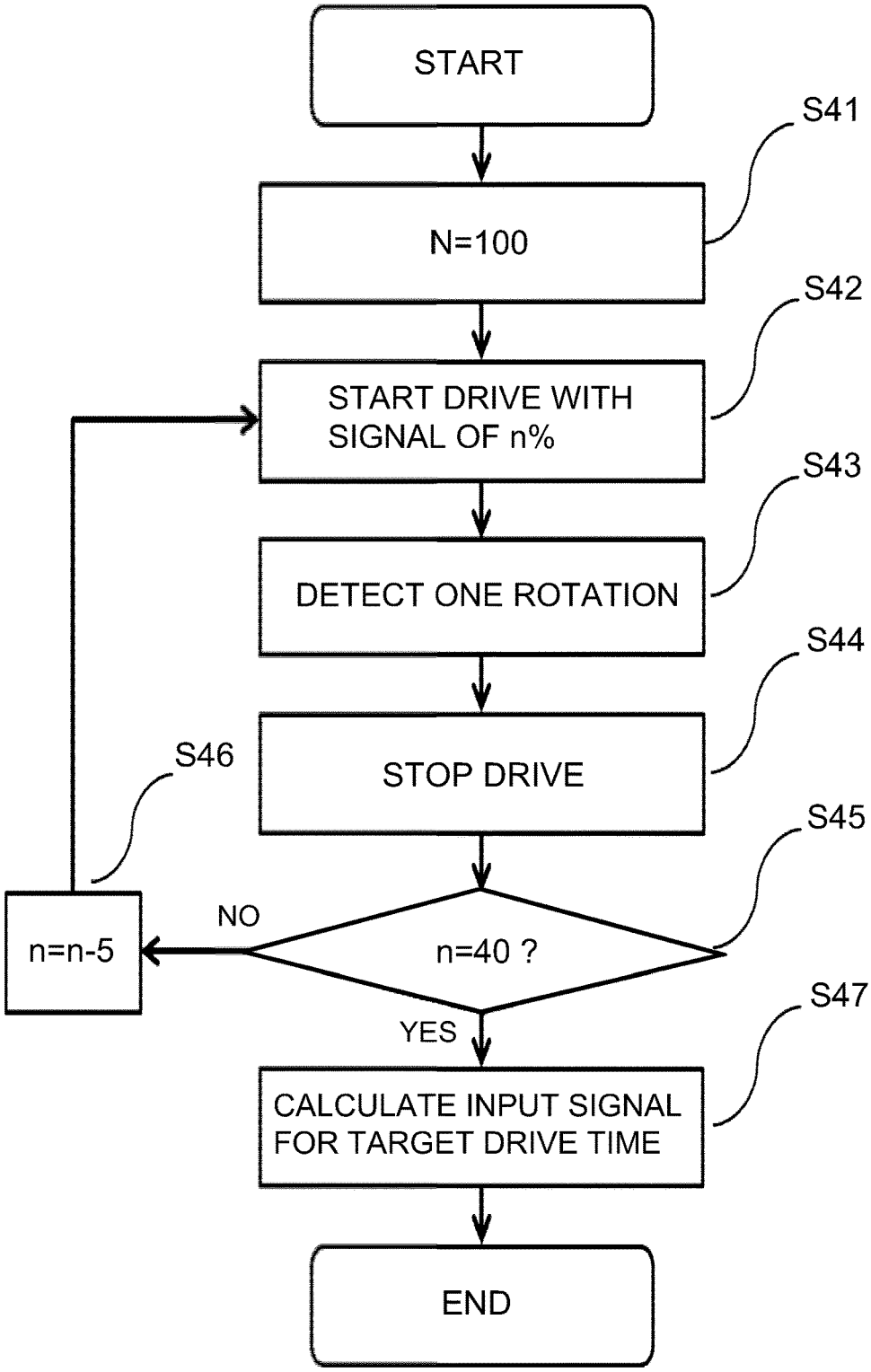

FIG. 17 is a flowchart showing a procedure for determining an initial input value in the image forming apparatus in the Fifth Embodiment.

Figure 18:
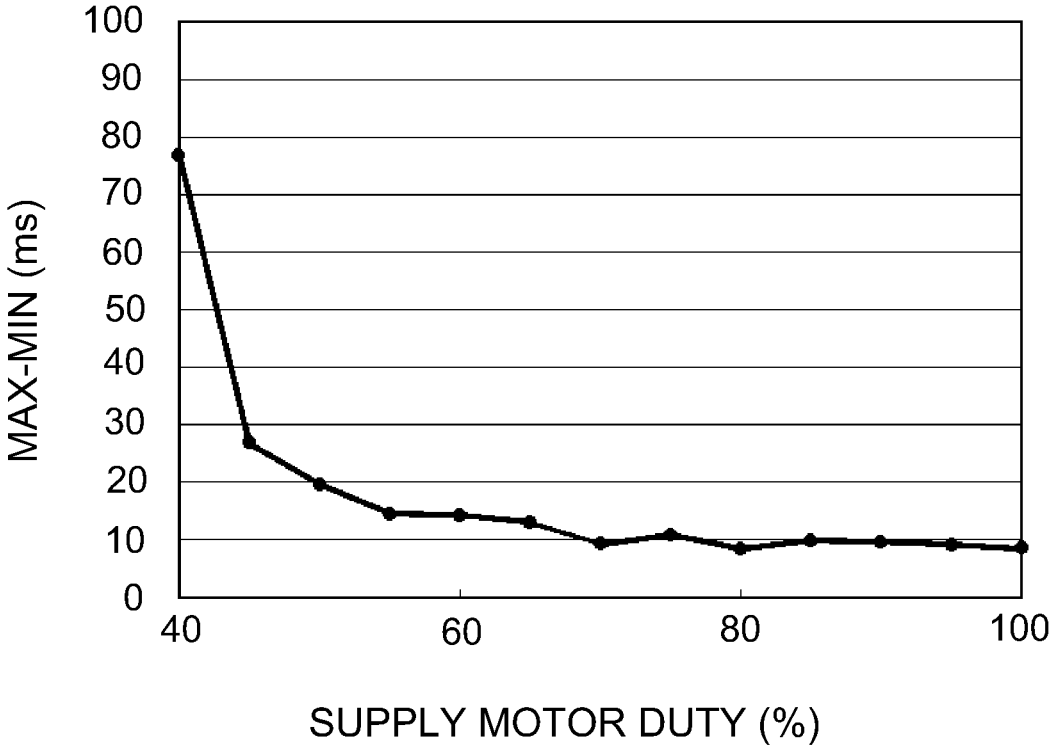

FIG. 18 is a graph showing a relationship between an input value of a toner supply motor and a variation in one rotation detection time in a toner absence state in an image forming apparatus according to a Sixth Embodiment.

Figure 19:
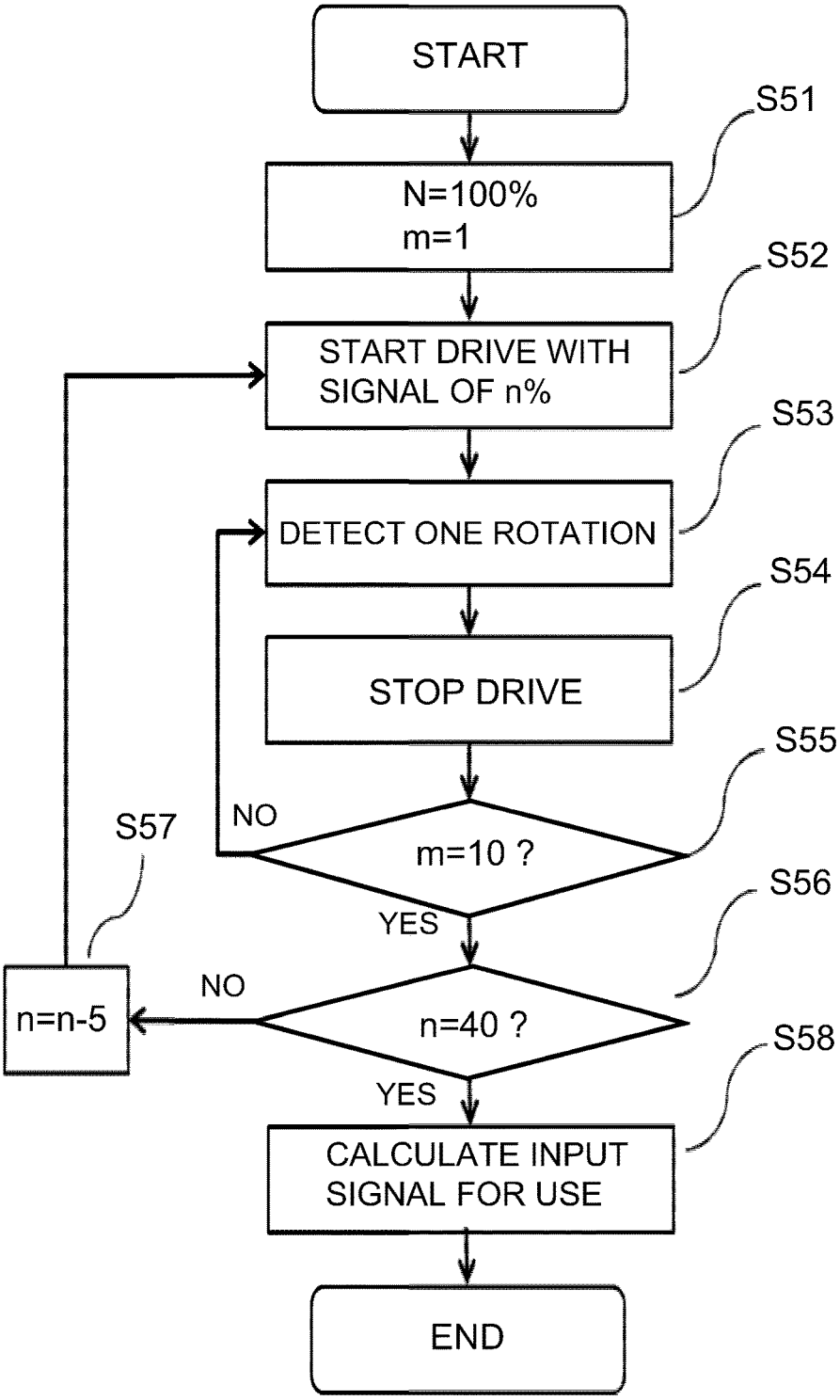

FIG. 19 is a flowchart showing a procedure for determining a threshold of an input signal in the image forming apparatus in the Sixth Embodiment.

DESCRIPTION OF EMBODIMENTS

<First Embodiment>

In the following, the First Embodiment of the present invention will be specifically described with reference to FIGS. 1-6. In this embodiment, as an example of an image forming apparatus 1, a full-color printer of a tandem type is described. However, the present invention is not limited to the image forming apparatus 1 of the tandem type, but may also be an image forming apparatus of another type. Further, the image forming apparatus 1 is not limited to the full-color image forming apparatus, but may also be a monochromatic image forming apparatus or a single-color image forming apparatus. Or, the image forming apparatus 1 can be carried out in various uses such as printers, various printing machines, copying machines, facsimile machines and multi-function machines.

Figure 1:
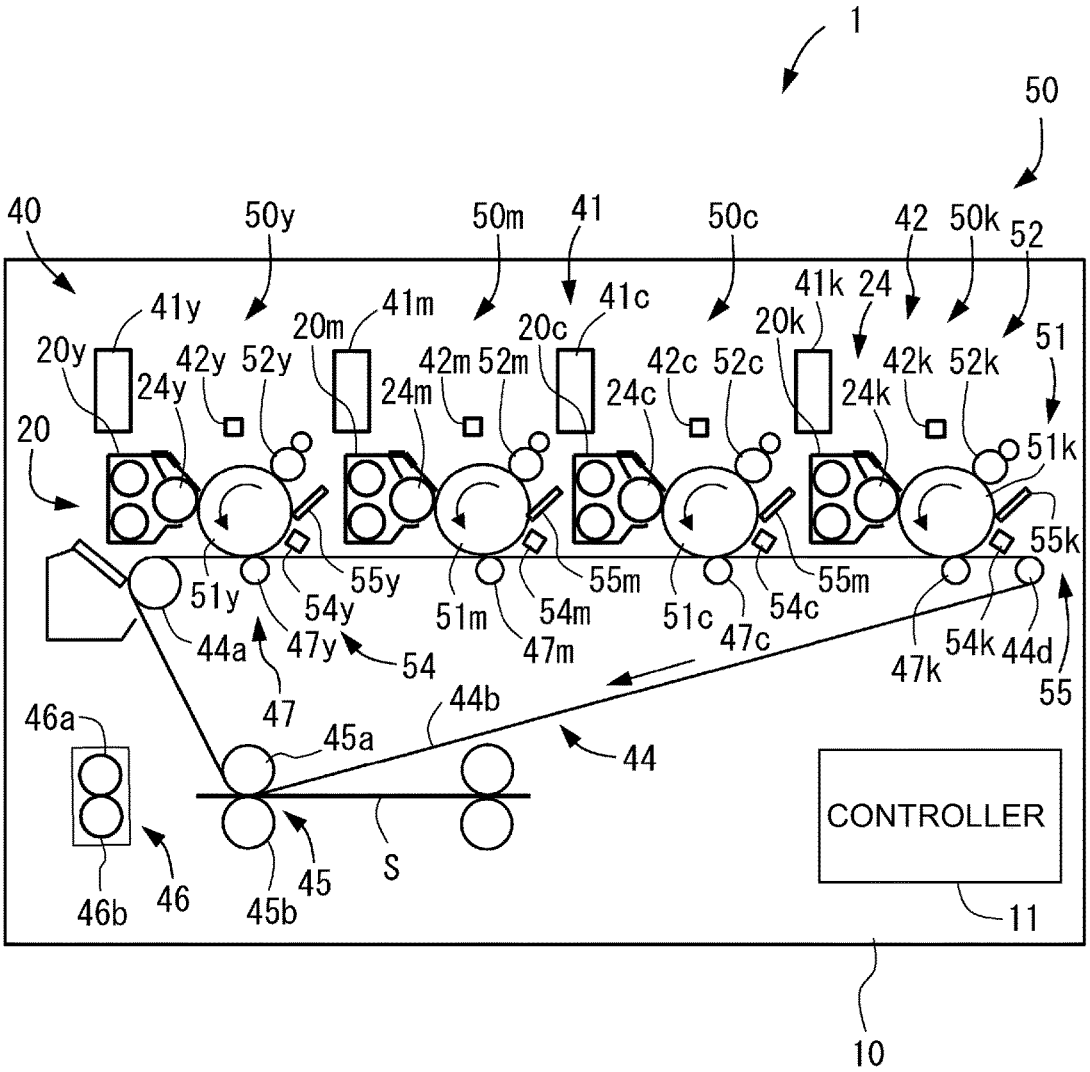
FIG. 1 is a sectional view showing a schematic structure of an image forming apparatus according to a First Embodiment of the present invention.

As shown in FIG. 1, the image forming apparatus 1 includes an apparatus main assembly 10, an unshown sheet feeding portion, an image forming portion 40, an unshown sheet discharging portion and a controller 11. The image forming apparatus 1 is capable of forming a four-color based full-color image on a recording material depending on an input signal from an unshown host device such as an original reading device or a personal computer, or from an unshown external device such as a digital camera or a smartphone. Incidentally, on a sheet S which is the recording material, a toner image is to be formed, and specific examples of the sheet S include plain paper, a synthetic resin sheet as a substitute for the plain paper, thick paper, a sheet for an overhead projector, and the like.

In this embodiment, a two-component developer including magnetic toner and a non-magnetic carrier is used. The toner includes a base material including a binder resin containing a colorant and includes an additive added in the base material. As a resin material forming the toner, in this embodiment, a negatively chargeable polyester-based resin material was used. As regards a particle size of the toner, when the toner particle size is excessively small, the toner is not readily rubbed with the carrier and thus a charge amount of the toner is not readily controlled, and when the toner particle size is excessively large, a fine toner image cannot be formed. For this reason, a volume-average particle size of the toner may preferably be 4 μm or more and 10 μm or less, and in this embodiment, the toner having the volume-average particle size of 7 μm was used. As the carrier, it is possible to use surface-oxidized or unoxidized metals such as iron, nickel, cobalt, manganese, chromium and rare-earth metal; alloys of these metals; oxides of these metals such as ferrite. As regards a particle size of the carrier, when the carrier particle size is excessively small, the carrier is easily deposited on an image bearing member during development, and when the carrier particle size is excessively large, the carrier disturbs the toner image during the development. Therefore, in this embodiment, a ferrite carrier having a volume-average particle size of 40 μm was used. In this embodiment, 300 g of the developer was accommodated in a developer container, and the developer during the accommodation (in an initial stage) contained the toner and the carrier in a weight ratio of 1:9.

The image forming portion 40 is capable of forming an image on the sheet S fed from the sheet feeding portion, on the basis of image information. The image forming portion 40 includes process cartridges 50*y*, 50*m*, 50*c* and 50*k*, toner bottles 41*y*, 41*m*, 41*c* and 41*k*, exposure devices 42*y*, 42*m*, 42*c* and 42*k*, an intermediary transfer unit 44, a secondary transfer portion 45 and a fixing portion 46. Incidentally, the image forming apparatus 1 in this embodiment is capable of forming a full-color image and includes the process cartridge 50*y* for yellow (y), 50*m* for magenta (m), 50*c* for cyan (c) and 50*k* for black (k), which have the same constitution and which are provided separately. For this reason, in FIG. 1, respective constituent elements for four colors are shown by adding associated color identifiers to associated reference numerals, but in other figures and in the specification, the constituent elements are also described using only the reference numerals without adding the color identifiers in some cases.

The process cartridge 50 includes a photosensitive drum 50 moving while carrying a toner image, a charging roller 52, a developing device 20, a pre-exposure device 54 and a regulating blade 55. The process cartridge 50 is an integrally assembled unit detachably mountable to the apparatus main assembly 10.

The photosensitive drum 50 is rotatable and carriers and electrostatic image used for image formation. The photosensitive drum 50 is constituted by laminating, on an outer peripheral surface of an aluminum cylinder of 80 mm in diameter, an organic photoconductor (OPC) layer consisting of three layers including an undercoat layer, a photocharge generating layer and a photocharge transporting layer which are successively coated in a named order. The photosensitive drum 51 is rotatably supported at end portions thereof by bearings and is rotationally driven in a rotational direction R1 (FIG. 2) by transmitting a driving force from an unshown driving source to one end portion thereof.

Figure 2:
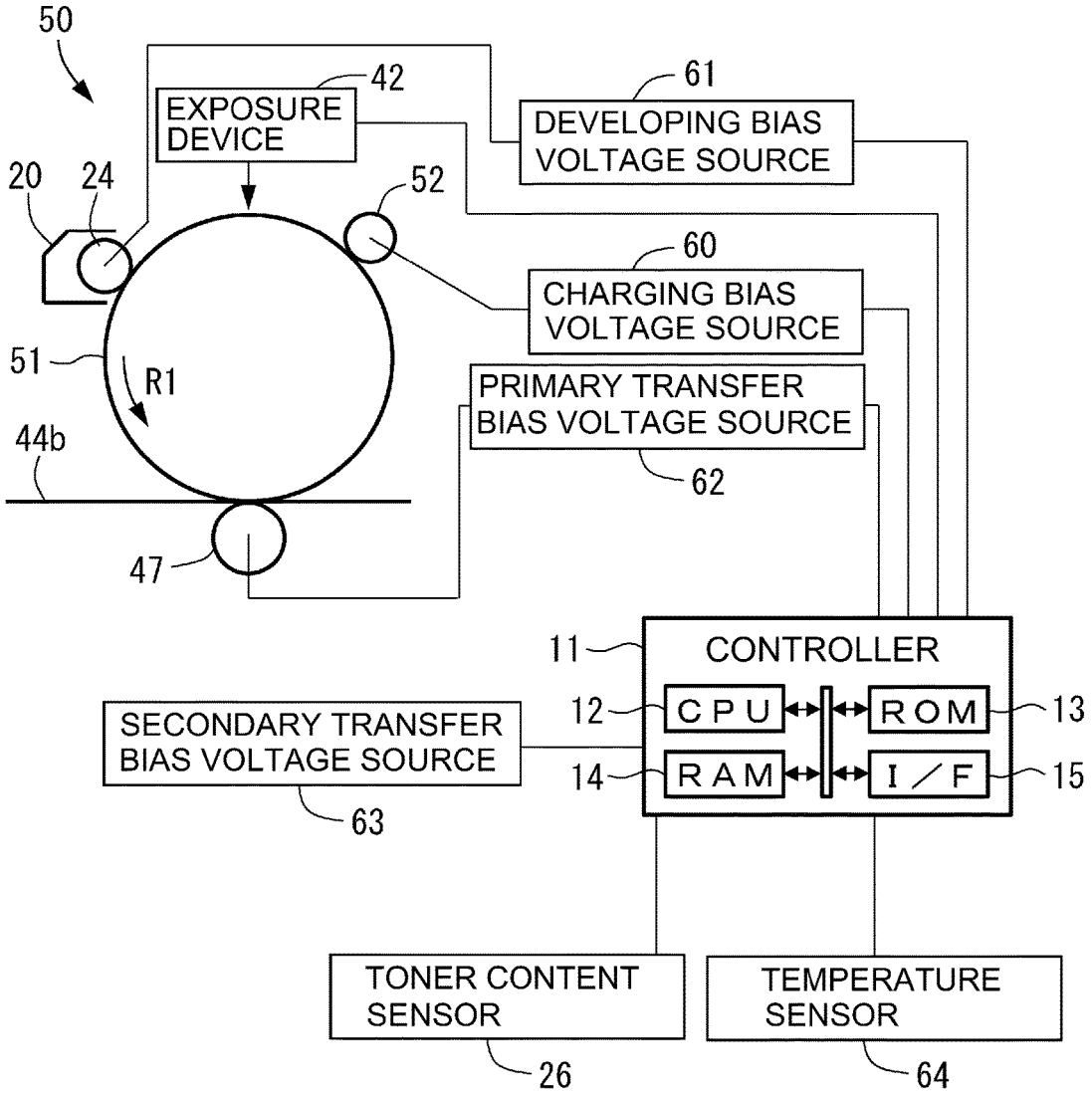
FIG. 2 is a schematic block diagram showing a control system of the image forming apparatus in the First Embodiment.

The charging roller 52 uses a rubber roller rotated by the photosensitive drum 51 in contact with a surface of the photosensitive drum 51 in a length of 320 mm, for example, and electrically charges the surface of the photosensitive drum 1 uniformly. To the charging roller 52, a charging bias voltage source 60 is connected (FIG. 2). The charging bias voltage source 60 applies a DC voltage as a charging bias to the charging roller 52 and electrically charges the photosensitive drum 51 through the charging roller 52. The exposure device 42 is a laser scanner and emits laser light in accordance with image information of separated color outputted from the controller 11.

The developing device 20 develops, with the toner, the electrostatic image formed on the photosensitive drum 51 under application of a developing bias. The developing device 20 includes a developing sleeve 24. To the developing sleeve 24, a developing bias voltage source 61 is connected (FIG. 2). Further, in the neighborhood of the developing device 20, a temperature sensor 64 (FIG. 2) is provided and detects a value relating to a temperature of the developer accommodated in a developer container 21. Details of the developing device 20 will be described later.

The toner image formed on the photosensitive drum 51 is primary-transferred onto an intermediary transfer unit 44. The surface of the photosensitive drum 51 after primary transfer is discharged by the pre-exposure device 54. The cleaning blade 55 is of a counter blade type and is contacted to the photosensitive drum 51 with a predetermined pressing force. Toner residual toner remaining on the surface of the photosensitive drum 51 after the primary transfer without being transferred onto the intermediary transfer unit 44 is removed by the cleaning bias provided in contact with the photosensitive drum 51 and thus is collected, and the image forming apparatus 1 prepares for a subsequent image forming step.

The intermediary transfer unit 44 includes a plurality of rollers including a driving roller 44*a*, a follower roller 44*d* and the primary transfer rollers 47*y*, 47*m*, 47*c* and 47*k* and includes the intermediary transfer belt 44*b* wound around these rollers, for carrying the toner images. The primary transfer rollers 47*y*, 47*m*, 47*c* and 47*k* are disposed opposed to the photosensitive drums 44*y*, 44*m*, 44*c* and 44*k*, respectively, and contact the intermediary transfer belt 44*b*, and primary-transfers the toner images onto the intermediary transfer belt 44*b*.

The intermediary transfer belt 44*b* contacts the photosensitive drum 51 and forms a primary transfer portion between itself and the photosensitive drum 51, and at the primary transfer portion, the toner image formed on the photosensitive drum 51 is primary-transferred under application of a primary transfer bias from a primary transfer bias voltage source 62 (FIG. 2).

By applying a positive primary transfer bias to the intermediary transfer belt 44*b* through the primary transfer rollers 47, negative toner images on the photosensitive drums 51 are multiple-transferred successively onto the intermediary transfer belt 44*b*.

A secondary transfer portion 45 includes an inner secondary transfer roller 45*a* and an outer secondary transfer roller (transfer means) 45*b*. By applying a positive secondary transfer bias from a secondary transfer bias voltage source 63 (FIG. 2) to the outer secondary transfer roller 45*b*, the full-color toner image formed on the intermediary transfer belt 44*b* is transferred onto the sheet S. The outer secondary transfer roller 45*b* contacts the intermediary transfer belt 44*b* and forms the secondary transfer portion 45 between itself and the intermediary transfer belt 44*b*, and at the secondary transfer portion 45, the toner images primary-transferred on the intermediary transfer belt 44*b* are secondary-transferred onto the sheet S under application of the secondary transfer bias.

The fixing portion 46 includes a fixing roller 46*a* and a pressing roller 46*b*. The sheet S is nipped and fed between the fixing roller 46*a* and the pressing roller 46*b*, whereby the toner image transferred on the sheet S are heated and pressed and are fixed on the sheet S.

The sheet discharging portion feeds the sheet S fed along a discharging path after the fixing, and discharges the sheet S through, e.g., a discharge opening. The thus discharged sheet S is stacked on a discharge tray.

As shown in FIG. 2, the controller 11 is constituted by a computer and includes, for example, a CPU 12, a ROM 13 for storing a program for controlling the respective portions, a RAM 14 for temporarily storing data, and an input/output circuit (I/F) 15 through which signals are inputted from and outputted into an external device. The CPU 12 is a microprocessor for managing an entirety of control of the image forming apparatus 1 and is a main body of a system controller. The CPU 12 is connected with the sheet feeding portion, the image forming portion 40 and the sheet discharging portion and the like via the input/output circuit 15 and not only transfers signals with the respective portions but also controls operations of the respective portions. In the ROM 13, an image forming control sequence for forming the image on the sheet S and the like are stored. The controller 11 is connected to various voltage sources such as the charging bias voltage source 60, the developing bias voltage source 61, the primary transfer bias voltage source 62, the secondary transfer bias voltage source 63 and the like and controls these voltage sources. Further, the controller 11 is connected to a toner content sensor 26 and a temperature sensor 64 and receives electric signals from the respective sensors.

Next, an image forming operation of the image forming apparatus 1 constituted as described above will be described.

When the image forming operation is started, first, the photosensitive drum 51 is rotated and the surface thereof is electrically charged by the charging roller 52. Then, on the basis of the image information, the laser light is emitted from the exposure device 42 to the photosensitive drum 51, so that the electrostatic latent image is formed on the surface of the photosensitive drum 51. The toner is deposited on this electrostatic latent image, whereby the electrostatic latent image is developed and visualized as the toner image and then the toner image is primary-transferred onto the intermediary transfer belt 44*b*. After the primary transfer, the toner remaining on the photosensitive drum 51 without being transferred onto the intermediary transfer unit 44 is removed by the cleaning blade 55.

On the other hand, the sheet S is supplied in parallel to such a toner image forming operation and is conveyed to the secondary transfer portion 45 along the feeding path by being timed to the toner image on the intermediary transfer belt 44*b*. Then, the image is secondary-transferred from the intermediary transfer belt 44*b* onto the sheet S. The sheet S is conveyed to the fixing portion 46, in which the unfixed toner image is heated and pressed and thus is fixed on the surface of the sheet S, and then the sheet S is discharged from the apparatus main assembly 10.

Figure 3:
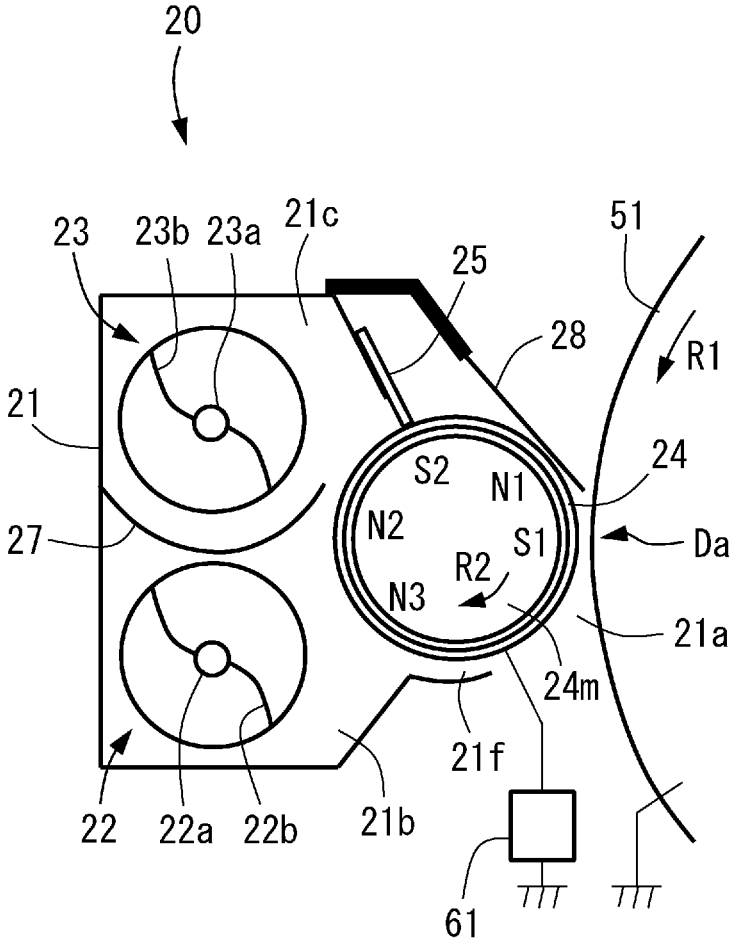
FIG. 3 is a cross-sectional (detailed) view showing a developing device of the image forming apparatus in the First Embodiment as seen in the same direction as in FIG. 1.
Figure 4:
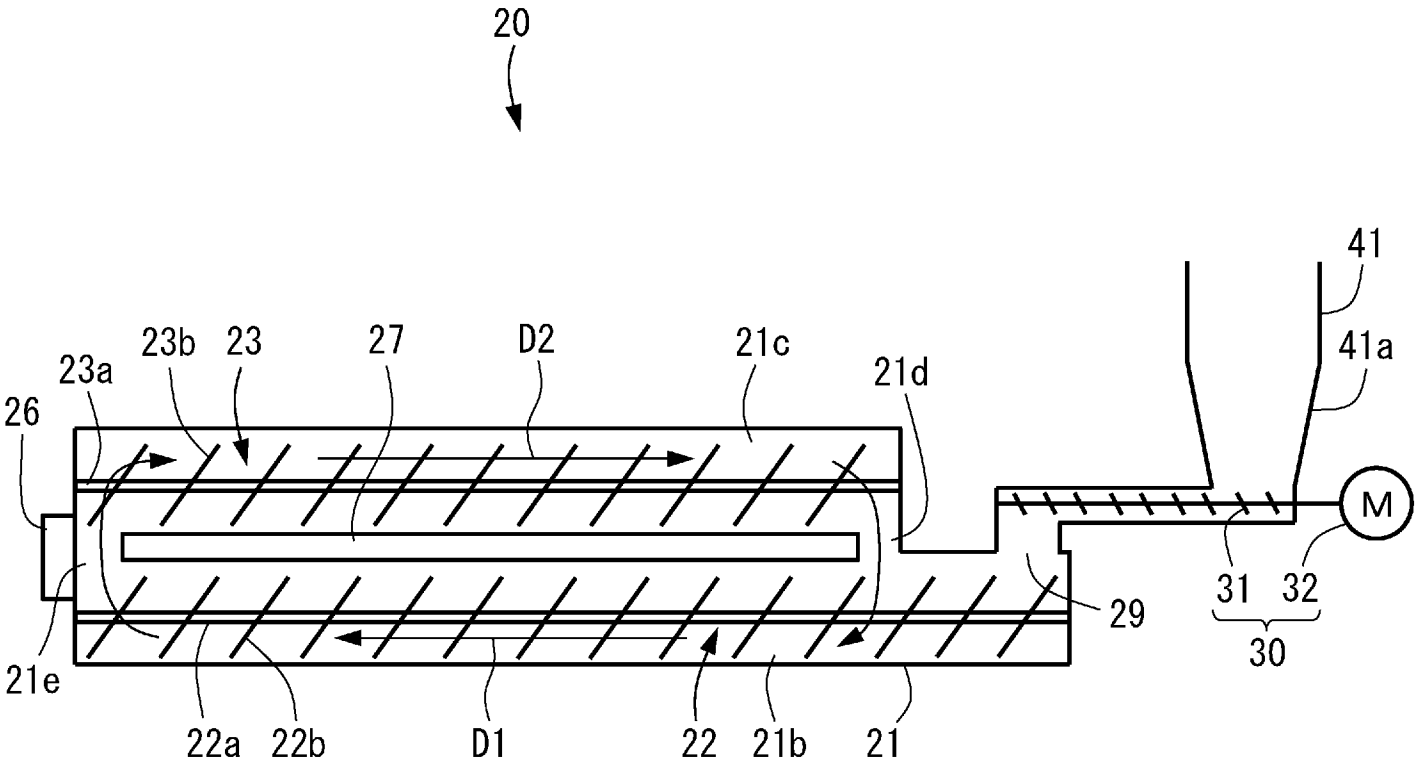
FIG. 4 is a longitudinal sectional (detailed) view showing the developing device of the image forming apparatus in the First Embodiment as seen in a direction perpendicular to a direction of FIG. 1.

The developing device 20 in the image forming apparatus 1 of this embodiment will be specifically described with reference to FIGS. 3 and 4. The developing device 20 is detachably mountable to the apparatus main assembly 10 and includes the developer container 21 for accommodating the developer, first and second feeding screws 22 and 23, the developing sleeve 24, a regulating blade 25 and the toner content sensor 26. The developing device 20 develops, with the toner, the electrostatic image formed on the photosensitive drum 51. The developer container 21 is provided with an opening 21*a* where the developing sleeve 24 is exposed at a position opposing the photosensitive drum 51. The developer container 21 includes a partition wall 27 extending substantially parallel to a longitudinal direction substantially at a central portion. The developer container 21 is partitioned by the partition wall 27 into a supplying chamber 21*c* and a collecting chamber 21*b* with respect to a vertical (up-down) direction. The developer is accommodated in the supplying chamber 21*c* and the collecting chamber 21*b*. In the supplying chamber 21*c*, the developer is fed to the developing sleeve 24. The collecting chamber 21*b* communicates with the supplying chamber 21*c*, and the developer is collected from the developing sleeve 24 and is stirred. The partition wall 27 between the supplying chamber 21*c* and the collecting chamber 21*b* is provided with end portions, thereof with a downward communication portion 21*d* and an upward communication portion 21*e* which establish communication between the supplying chamber 21*c* and the collecting chamber 21*b* with respect to the vertical direction. Through the downward communication portion 21*d*, the developer passed through the supplying chamber 21*c* without being supplied to the developing sleeve 24 is moved downward to the collecting chamber 21*b*. Through the upward communication portion 21*e*, the developer collected from the developing sleeve 24 in the collecting chamber 21*b* and the developer moved downward from the supplying chamber 2*k* are moved upward to the supplying chamber 21*c*. In the developing device 20 in this embodiment, the supplying chamber 21*c* and the collecting chamber 21*b* are disposed in the vertical direction, but the present invention is not limited thereto. The supplying and collecting chambers may also be adjacently disposed in a horizontal direction or in another form in the developing device 20.

The first feeding screw 22 is disposed in the collecting chamber 21*b* in substantially parallel with the developing sleeve 24, and feeds the developer accommodated in the collecting chamber 21*b* while stirring the developer. The first feeding screw 22 includes a magnetic shaft portion 22*a* rotatably provided in the developer container 21 and includes a helical feeding blade 22*b*, rotating integrally with the shaft portion 22*a*, for feeding the developer accommodated in the developer container 21 in a feeding direction D1 by rotation thereof. The second feeding screw 23 is disposed in the supplying chamber 21*c* in substantially parallel with the first feeding screw 22, and feeds the developer accommodated in the supplying chamber 21*c* in a direction opposite to the feeding direction of the first feeding screw 22. The second feeding screw 23 includes a magnetic shaft portion 23*a* rotatably provided in the developer container 21 and includes a helical feeding blade 23*b*, rotating integrally with the shaft portion 23*a*, for feeding the developer accommodated in the developer container 21 in a feeding direction D2 by rotation thereof. By the feeding through the rotation of the respective feeding screws 22 and 23, the developer is circulated between the developing chamber 21*c* and the collecting chamber 21*b* through the upward communication portion 21*e* and the downstream communication portion 21*d* which are provided at the end portions of the partition wall 27. In this embodiment, the respective shaft portions 22*a* and 23*a* are rotated at 900 rpm and thus circulate the developer. The toner is triboelectrically charged to the negative polarity by sliding with the carrier under stirring by the respective feeding screws 22 and 23.

The developing sleeve 24 carries the developer including the non-magnetic toner and the magnetic carrier, and feeds the developer to a developing region Da opposing the photosensitive drum 1. The developing sleeve 24 is constituted by a non-magnetic material such as aluminum or non-magnetic stainless steel, and is formed in this embodiment of aluminum so as to have a diameter of 20 mm. Inside the developing sleeve 24, a roller-shaped magnet roller 24*m* is fixedly provided to the developer container 21 in a non-rotatable state. The magnet roller 24*m* includes a developing magnetic pole S1 and magnetic poles N1, S2, N2 and N3. By a magnetic field of the developing magnetic pole S1, the developer forms a magnetic brush, and this magnetic brush develops the electrostatic latent image into the toner image with the charged toner while being contacted to the photosensitive drum 1 in the developing region Da. With the feeding of the developer by the second feeding screw 23, the developer is raised and supplied to the developing sleeve 24. In the developer, the toner is mixed with the magnetic carrier, and therefore, the developer is constrained by the magnetic pole N2. Then, with rotation of the developing sleeve 24, the developer passes through the magnetic pole S2, so that the amount of the developer is regulated in a predetermined amount. The thus-regulated developer passes through the magnetic pole N1 and is supplied to the developing magnetic pole S1 opposing the photosensitive drum 1. The developer passes through the developing region Da, and the toner thereof is consumed on the electrostatic latent image. Then, between the magnetic poles N3 and N2, the developer is liberated from a magnetic force of constraint by the magnetic poles and is peeled off of the surface of the developing sleeve 24, so that the developer is collected in the collecting chamber 21*b*.

The regulating blade 25 is disposed opposed to the developing sleeve 24 on a side upstream of the developing region Da with respect to the rotational direction R2 of the developing sleeve 24 in order that the amount of the developer carried on the developing sleeve 24 and supplied to the electrostatic latent image is a predetermined amount. As the regulating blade 25, an aluminum plate-shaped member extending in a longitudinal axis direction is used. The regulating blade 25 is provided in the developer container 21 so that a free end thereof orients toward a center of the developing sleeve 24 on a side upstream of the photosensitive drum 51 with respect to the rotational direction R2 of the developing sleeve 24. By rotation of the developing sleeve 24, the developer passes through between the free end portion of the regulating blade 25 and the developing sleeve 24 and is fed to the developing region Da.

By adjusting a gap between the regulating blade 24 and the surface of the developing sleeve 24, an amount of the developer fed to the developing region Da while being carried on the developing sleeve 24 can be adjusted. Incidentally, when the gap between the regulating blade 25 and the developing sleeve 25 is excessively narrow, a foreign matter and agglomerated toner in the developer are undesirably liable to clog in the gap. Further, when a weight per unit area of the developer conveyed on the developing sleeve 24 is excessively large, there is a liability that the developer clogs and the carrier is deposited on the photosensitive drum 51 in the neighborhood of an opposing position to the photosensitive drum 1. On the other hand, when the weight per unit area of the developer conveyed on the developing sleeve 24 is excessively small, there is a liability that the electrostatic latent image cannot be developed into a desired toner image and thus an image density lowers. In order to avoid these problems, in this embodiment, the gap between the regulating blade 25 and the developing sleeve 24 was set at 400 μm so as to provide a developer feeding amount of 30 mg/cm.

Further, on a side upstream of the opening 21*a* of the developer container 21 with respect to the rotational direction R2 of the developing sleeve 24, a scattering preventing sheet 28 contacting the developing sleeve 24 at a free end thereof is provided. The scattering preventing sheet 28 prevents scattering of the toner in contact with the developer in the neighborhood of the magnetic pole N1, where the polarity of the magnetic pole is inverted and the magnetic brush of the developer flutters, in order to prevent toner scattering occurring with feeding of the developer.

In the developing region Da, the developing sleeve 24 moves in the same direction as the movement direction of the photosensitive drum 51, so that the photosensitive drum 51 rotates at a peripheral speed of 320 mm/s and the developing sleeve 24 rotates at a peripheral speed of 480 mm/s. A peripheral speed ratio increases a toner supply amount with an increasing value thereof, but when the peripheral speed ratio is excessively large, a problem such as the toner scattering arises. For this reason, the peripheral speed ratio between the developing sleeve 24 and the photosensitive drum 51 is set between 1-2 times in general. Further, a toner consumption amount at a maximum density portion is 0.5 mg/cm$^2$, and in the case where the toner in a maximum amount is consumed on an A4-size sheet, 0.31 g of the toner is used.

On a side downstream of the developing region Da of the developing sleeve Da with respect to the rotational direction R2, an intake portion 21*f* is provided between the developing sleeve 24 and the developer container 21. The developer regulated by the regulating blade 25 and passed through the developing region Da is collected through the intake portion 21*f*, and therefore, an amount of the developer capable of passing through the intake portion 21*f* is larger than an amount of the developer regulated by the regulating blade 25. This is because even in the case where a feeding amount of the developer reaching the intake portion 21*f* becomes larger than the amount of the developer regulated by the regulating blade 25, the developer is caused to be taken in the developer container 21 through the intake portion 21*f*. As the case where the amount of the developer regulated by the regulating blade 25, for example, it is possible to cite variations by mass production in shape of the regulating blade, gap between the regulating blade 25 and the developing sleeve 24, magnetic force of the magnetic roller 24*m*, characteristic of the developer, and the like. Alternatively, as the case where the amount of the developer regulated by the regulating blade, for example, there is a case that the developer is deteriorated by use for a long term. In this embodiment, a gap (interval) of the intake portion 21*f* is provided so as to take the developer in the developer container 21 in an amount of 60 mg/cm$^2$ compared with the developer feeding amount of 30 mg/cm$^2$.

The toner content sensor 26 is provided opposed to the upstream communication portion 21*e* on an outside of the developer container 21. The toner content sensor is an inductance sensor capable of detecting (magnetic) permeability of the developer or an inside of the developer container 21 under application of a control voltage. The toner content sensor 26 is connected to the controller 11 (FIG. 2) and detects the toner content of the developer fed through the upward communication portion 21*e*, and then sends a corresponding electric signal to the controller 11. The toner content of the developer in the developing device 20 is lowered by development of the electrostatic latent image on the photosensitive drum 51, and therefore, the toner content of the developer at the upward communication portion 21*e* is detected by the toner content sensor 26 provided opposed to the developer in the upward communication portion 21*e*. The controller 11 is capable of carrying out toner supply control with the toner content sensor 26.

The permeability of the developer is detected by the toner content sensor 26, and the controller 11 calculates a ratio between the toner and the carrier and adjusts the supply amount of the toner from the toner bottle so that the toner content is a target toner content. When a deviation of the toner content form the target toner content generates, the controller 11 corrects the toner supply amount and thus carry out control so that the toner content coincides with a target value. Here, a supply amount of the toner supplied depending on a detection result of the toner content sensor 26, i.e., a supply amount for correcting a difference between an actual supply amount and a predicted supply amount is a correction amount Si. In the case where the target toner content is Tt and a detected toner content actually detected is Ts, when Ts>Tt is satisfied, the correction amount Si is positive, and when Tt>Ts is satisfied, the correction amount Si is negative. Further, the toner content has a proper range, and therefore, in general, the target toner content Tt has upper and lower limits. In this embodiment, the target toner content Tt is used in a range of 6-12%.

In the collecting chamber 21*b*, at an upstream end portion with respect to the developer feeding direction D1, a supply opening 29 which opens upward is formed, and a toner bottle 41 is connected with the supply opening 29 via a hopper 41*a*. The toner bottle 41 accommodates a supplying two-component developer in which the toner and the carrier are mixed (in general, toner/(supplying developer)=100% to 80%). The toner supplied from the toner bottle 41 is replenished into the collecting chamber 21*b* through the supply opening 29 via the hopper 41*a*. A supplying (replenishing) portion (supplying means) 30 is provided between the supply opening 29 and the hopper 41*a* provided above the supply opening 29 of the developing device 20. The supplying portion 30 includes a supplying screw (supplying member) 31 and a driving motor (driving source) 32. The supplying screw 31 is connected with the supply opening 29 and supplies the developer to the developer container 21 by rotation thereof. The driving motor 32 is connected with the controller 11. The controller 11 drives the driving motor 32, so that the supplying screw 31 is rotated and thus the supplying toner is supplied to the supply opening 29 of the developer container 21. As the driving motor 32, a stepping motor capable of controlling a rotation time and a rotational speed is used. However, as the driving motor 32 capable of controlling the rotational speed, the motor is not limited to the stepping motor, but a DC motor and a photo-interrupter may also be used.

In this embodiment, a type in which the toner is supplied by rotating the supplying screw 31 an integer of times of rotation is used. In this type, a phase of a screw blade is unchanged every rotation of the supplying screw 31, and therefore, the type is advantageous for control with high accuracy in terms of stable single (one) supply amount. In this embodiment, the toner in an amount substantially equal to the amount of the toner consumed in the developing device 20 is supplied from the toner bottle 41. The supplied toner enters an upstream portion of the collecting chamber 21*b* through the supply opening 29 and is fed by the first screw 22, and thus enters the circulating path. Incidentally, the supply opening 29 communicates with a downstream side of the supplying chamber 21*c*. This is because the toner entering the circulating path is prevented from entering the supplying chamber 21*c* before being sufficiently stirred and thus from being supplied to the developing sleeve 24.

Here, a countermeasure against a change in toner characteristic in the image forming apparatus 1 of this embodiment will be described. With image formation, a load is exerted on the toner in the developing device 20, so that a shape and surface property of the toner changes and thus a toner characteristic changes. Such a change in toner characteristic depends on a time in which the load is exerted on the toner in the developing device 20, and therefore, the change is conspicuous when printing of the image with a small toner consumption amount is continued. In the case of an image forming apparatus including a plurality of developing devices 20, the developing device 20 in which no toner is consumed at all can exist. In general, in the case where a necessary minimum toner consumption amount is set every predetermined number of sheets or every predetermined number of times of rotation of the developing sleeve 24 and an actual toner consumption amount is below the set toner consumption amount, control such that the toner is used in a region other than an image forming region or in an interval between image forming periods and is replaced with fresh toner is carried out. In this embodiment, the necessary minimum toner consumption amount was 1% of entire surface consumption when the necessary minimum toner consumption amount in the case where an entire surface maximum density image is outputted on an A4-size basis (entire surface consumption) is 100%. That is, in the case where an average toner consumption amount per predetermined number of sheets is below 1% of the entire surface consumption, control in which the toner is consumed is carried out so as to provide the average toner consumption amount of 1%. Accordingly, the change in toner characteristic is maximum in the case where the image with the toner consumption amount of 1% or less is continuously printed. However, there is a need to pass about 10,000 sheets through the transfer portion until an average time in which the load is exerted on the toner becomes a steady value. This value can be calculated from the toner consumption amount and the amount of the toner in the developing device 20.

Next, a necessary supply amount St which is a supply amount needed during supply of the toner will be described. The necessary supply amount St is acquired from the sum of a predicted supply amount Sv (supply amount in which the toner consumption amount is roughly predicted) calculated from image information and a correction amount Si (supply amount for correcting a difference size the actual consumption amount and a predicted consumption amount) calculated by a difference between a detection result of the toner content sensor 26 and a target value. In this embodiment, the predicted supply amount Sv is calculated depending on a print area and is 0.3 (g) when the A4-size entire printing is carried out. In the case where a print ratio of the A4-size entire printing is 1, the predicted supply amount Sv of the image with a print ratio $\alpha$ is $0.3\times(g)$. The correction amount Si is calculated from a detected toner content Ts during image formation with respect to a target toner content Tt. In this embodiment, a correction amount $Si=30\times(Tt-Ts)$ is used, and the supply amount is corrected during subsequent image formation to the image formation in which the correction amount is calculated. When $(Tt-Ts)$ is 0.01, i.e., when the detected toner content is smaller than the target toner content by 1%, 0.3 g of the toner supply amount is added, and when the detected toner content is larger than the target toner content by 1%, 0.3 g of the toner supply amount is reduced. When the detected toner content is smaller than target toner content by 1% in the case where 300 g of the developer is used, 3 g of the toner is needed until the detected toner content reaches the target toner content, but when the toner in a large amount is supplied at a time, a toner charge amount largely changes and causes a density (toner content) fluctuation, and therefore, the supply amount is corrected in a small degree. A calculating method of the correction amount Si may preferably be optimized depending on whether or not to what degree the toner stirring performance or the deviation of the toner content from the target value can be permitted. Further, the toner in an amount of the necessary supply amount is carried over to subsequent supply timing.

Next, the number of times of rotation for toner supply (toner supply rotation number) N will be described. The toner supply rotation number N is calculated from the necessary supply amount St and a unit supply amount Sb in which the toner is supplied by one rotation of the supplying screw 21. In this embodiment, the unit supply amount Sb is about 0.25 (g), so that the supply rotation number N includes an integer portion Sq and a fraction Sr of $N=St/Sb$, and the frequency Sr is carried over to a subsequent necessary supply amount St. At certain image formation start timing, the predicted supply amount Sv is Sv1, the correction amount Si is Si1, the last correction amount Si is SiO, and the last fraction Sr is SrO. At this time, the necessary supply amount St is $St=Sr1+SiO+SrO$, and when the integer portion and the fraction of $(Sr1+SiO+Sr0)/Sb$ are Sq1 and Sr1, respectively, a supply rotation number N1 is Sq1. At subsequent image formation start timing, when the predicted supply amount Sr is Sv2 and the correction amount Si is Si2, the necessary supply amount St is $St=Sv2+Si1+Sr1$, and when the integer portion and the fraction of $(Sr2+Si1+Sr1)/Sb$ are Sq2 and Sr2, respectively, a supply rotation number N2 is Sq2.

Next, a target time of the toner supply will be described. First, as a comparison example, a normal supply target time will be described. Even in the case where the member is continuously printed on an entire surface, the supplying screw 31 is rotated in a time such that the toner supply is in time. In the case of the A4 size, 0.3 (g) of the toner is required for the entire surface printing, and therefore, the supplying screw 31 is rotated in a time in which the supplying screw 31 can be rotated two turns. In order to prepare for the case where the toner charge amount is low and the toner consumption amount increases compared with an estimated value, there is a need that a suppliable amount allows a margin. Further, in the case where a sheet having a size larger than the A4 size can be passed through the transfer portion, also in consideration of such a case, there is a need to optimize a supply amount for one time and the number of suppliable times.

In the comparison example in this embodiment, a sub-scan direction length of the A4-size sheet is 210 (mm) and a traveling speed of the photosensitive drum 51 is 320 (mm/s), and therefore, a sheet passing time is 0.65 (s) and thus one rotation target time of the supplying screw 31 is set at 0.28 (s). In some cases, the rotation speed of the supplying screw 31 is slow due to the toner load or the like and thus the one rotation time is considerably slower than the one rotation target time, and therefore, when the supplying screw 31 cannot rotated one turn in 0.30 (s), image formation is interrupted. In the case where the supplying screw 31 is rotated plural turns in image formation of a single sheet, drive thereof is started every 0.32 (s). Further, in the case where a sheet having a different size is passed, a maximum number of times of rotation per (one) sheet is changed. For example, in the case of an A3-size sheet, the supplying screw 31 is rotated four turns at the maximum. In the case of a sheet having a size not less than the A3 size, the supplying screw 31 is caused to be capable of supplying the toner in an amount corresponding to one rotation with an increment of 0.32 (s) of the sheet passing time.

In the above-described comparison example, the toner supply is in time even in the case where the image is printed on an entire surface of the sheet and in the case where the toner content is deviated from a target value. However, a toner replacement ratio is high, and therefore, in some cases, a stirring time of the supplying toner decreased and a ratio of the toner immediately after supply to the developer in the developing device 20 increased. As a result, there has arisen a problem such that there is a liability that a degree of stirring of the toner is insufficient and agglomerated toner of the supplying toner is conveyed by the developing sleeve 24 and thus an occurrence frequency of an image contamination such that a deposited matter on the photosensitive drum 51 is transferred onto the sheet S becomes high. Here, the image contamination is about 1 mm-20 mm in most cases. Processability that the image contamination due to the agglomerated toner is outputted is higher with a larger toner supply amount. However, even when a total supply amount is the same, the occurrence frequency of the image contamination is higher in the case where the number of times of collective supply is larger. This would be considered due to a liability of insufficient stirring of the supplying toner caused by a lowering in possibility of contact of the supplying toner with the carrier due to mutual contact between the supplying toner particles in the developer in the case where the toner in a large amount is supplied in a short time.

Here, an experiment on the occurrence frequency of the image contamination in the case where the toner is supplied in a certain amount will be described. A degree of the occurrence of the image contamination in the case where the toner is continuously supplied from first supply timing while passing 25 A4-size sheets without printing the image on the sheets is compared. In the developing device 20 in this embodiment, the toner supplied during passing of about 20 A4-size sheets is circulated several times in the developing device 20 and thus the agglomerated toner is broken (loosened) in many cases, and therefore, substantially no image contamination occurs on or after passing of 20 sheets. In view of this, comparison was made in the case of passing of 25 sheets.

The image contamination occurs in the case where the supplied toner is agglomerated and is fed by the developing sleeve 24. The degree of the occurrence of the image contamination probabilistically fluctuates due to how large and hard agglomerated toner exists in the supplied toner, that such agglomerated toner is broken during circulation and feeding of the developer and that the agglomerated toner is fed to the developing sleeve 24 at what timing. In this experiment, depending on a manner of the supply of the supplying toner, the number of sheets in which image contamination can occur can be estimated. However, as a result of the number of sheets, one obtained by correcting the sheet number corresponding to the case where the image contamination cannot be detected in a non-sheet-passing region due to a sheet size and a sheet interval with respect to a main scanning direction was used. This result is an estimated maximum value in which the image contamination can occur, so that the number of particles of the image contamination actually generating on the sheet is different depending on a sheet passing region. That is, even when the agglomerated toner is circulated and fed in the developing device 20 in the same manner, the number of particles generating on an actual output product fluctuates depending on the sheet size, the number of sheets passed after the toner supply, a sheet interval by various pieces of control, and the like. Further, particularly, in the case where the print ratio is high, the image contamination portion overlaps with the image portion and thus cannot be recognized as the image contamination in some instances.

The occurrence frequency of the image contamination in the case of the toner supply was acquired by the number of particles generating per supply amount corresponding to 100 rotations (turns) while changing the number of times of continuous supply rotation. The toner stirring performance changes depending on the toner content, the developer amount, a temperature characteristic of the developer, and therefore, the experiment was conducted in an environment of 23° C. and 50% RH in a fixed condition that the toner content was 10% and the developer amount was 300 g. In order to prevent the influence of a difference in the number of times of continuous supply rotation, in either case, the occurrence frequency was converted into an occurrence frequency per supply amount corresponding to 100 rotations. A result thereof is shown in part (a) of FIG. 5. As shown in part (a) of FIG. 5, the occurrence frequency of the image contamination was higher with an increasing number of times of continuous supply rotation, and was low when the toner supply was carried out only one time in a division manner.

Then, an experiment on a supply time and the occurrence frequency of the image contamination will be described. The degree of occurrence of the toner content in the case where the toner in supplying toner amount corresponding to one rotation was supplied from first supply timing while changing a one rotation supply time and while passing 24 A4-size sheets without printing the image on the sheets was compared. In order to prevent the influence of the difference in the number of times of supply rotation, the occurrence frequency was converted into an occurrence frequency per supply amount corresponding to 100 rotations. Further, the toner stirring performance changes depending on the toner content and the developer amount, and therefore, the experiment was conducted in the fixed condition that the toner content was 10% and the developer amount was 300 g. A result thereof is shown in part (b) of FIG. 5. As shown in part (b) of FIG. 5, the occurrence frequency of the image contamination was lower in the case where the one rotation supply time is long than in the case where the one rotation supply time is short. This shows that when the toner is slowly dispersed and fed, the developer is easily stirred. However, this effect is not achieved when the one rotation supply time is not less than 1.4 s. This would be caused due to the presence of the agglomerated toner deposited in some instances on the photosensitive drum 1 to some extent before the agglomerated toner is broken. For this reason, as in this embodiment described later, in the case where the one rotation supply time is changed on the basis of the number of times of rotation for toner supply and the supply time, the supply time may have an upper limit.

Next, the toner supply in the image forming apparatus 1 of this embodiment will be described. In this embodiment, the toner supply amount per unit time is changed by changing a rotational speed of the supplying screw 31 on the basis of a necessary toner supply rotation number (the number of times of rotation for toner supply) N and a suppliable time T. The toner is supplied by taking a time so that the supplied toner is dispersed to the extent possible while increasing the rotational speed to not less than a speed at which the supplying screw 31 can be rotated the necessary toner supply rotation number N in the suppliable time T. In the case where a calculated suppliable time is T and the supply rotation number is an integer N, the supplying screw 31 is controlled so that the supplying screw 31 is rotated at a speed of one rotation (turn) in a time of a supply interval of T/N or less. Further, in the case where the supply rotation number is an integer M smaller than the integer N, the supplying screw 31 is controlled so as to be rotated at a speed of one rotation in a time of a supply interval of T/N or more and T/M or less.

In the following, description will be made specifically. First, for simple comparison, the case where the toner is supplied only during the image formation but is not supplied during the sheet interval will be described. The passing time of the A4-size sheet is 0.65 s. In this embodiment, an error threshold in the case where the supplying screw 31 is not rotated at a predetermined speed due to a load on the supplying screw 31 is set at a time 0.02 s before the supply interval, and a time for one rotation at a target speed is set at a time 0.02 s before the error threshold. That is, in the case where the predicted supply amount Sv is relatively small (second supply amount) and the supply rotation number N is one time (rotation), the supply interval of T/N is 0.65 s, and the supplying screw 31 is rotated at a target speed (1.6 rps) at which the screw is rotated one rotation in 0.61 s, and when the screw is not rotated one rotation in 0.63 s, the image formation is stopped. In the case where the predicted supply amount Sv is relatively large (first supply amount) and the supply rotation number N is two times, the supply time of T/N is 0.325 s, and the supplying screw 31 is rotated at a target speed (3.5 rps) at which the screw is rotated one rotation in 0.285 s from a leading end of the image, and when the screw is not rotated one rotation in 0.305 s, the image formation is stopped. Then second rotation is started at a time of 0.325 s, and when the screw is not rotated one rotation in 0.305 s after the start, the image formation is stopped.

That is, the controller 11 sets the predicted supply amount Sv of the toner supplied to the developer container 21, on the basis of the image information. Then, in the case where the predicted supply amount Sv is the first supply amount, the controller 11 causes the supplying screw 3) to rotate at a first speed (for example, 3.5 rps). Further, in the case where the predicted supply amount Sv is the second supply amount smaller than the first supply amount, the controller 11 causes the supplying screw 31 to rotate at a second speed (for example, 1.6 rps) slower than the first speed. Incidentally, in this embodiment, in the case of the A4-size sheet, the supply rotation number is set at 2 times at the maximum, and the supply interval T is correspondingly set at T−0.65 s. Further, in the case of an A3-size sheet, the supply rotation number is set at 4 times at the maximum, and the supply interval T is correspondingly set at T=1.3 s.

In the case of a maximum supply number in which the supply rotation number is determined by the sheet size, the supply speed is unchanged from that in the comparison example, so that an effect cannot be obtained. However, in this embodiment, although a maximum supply number is obtained when the image area on the A4-size sheet exceeds 84% of the entire sheet area, the case where such an image is continuously formed on the sheets did not exist in most instances. When image forming apparatuses operating in the market were checked, the case where the image with the image ratio of 80% or more on the A4-size sheet basis was formed was 1% or less. Further, the case where the image with the image ratio of 40% or more in average on the A4-size sheet basis was formed was about 1%.

Thus, a large supply rotation number relative to the supply time leads to a low frequency in actuality, and therefore, in this embodiment, priority is given to productivity in consideration of practicality, so that in the case of the maximum supply number, the supplying speed was kept equal to that in the comparison example.

Next, the case where the toner is supplied not only during the image formation but also in the sheet interval will be described. The sheet interval varies in general depending on various pieces of control and the like, but in this embodiment, the case where the sheet interval is constant in continuous sheet passing will be described. The passing time of the A4-size sheet is 0.65 s, and there is an interval of 0.75 s at a leading end of the sheet even in the case of continuous image formation in which the sheet interval of 30 mm is taken into consideration. In this embodiment, an error threshold in the case where the supplying screw 31 is not rotated at a predetermined speed due to a load on the supplying screw 31 is set at a time 0.02 s before the supply interval, and a time for one rotation at a target speed is set at a time 0.02 s before the error threshold. That is, in the case where the predicted supply amount Sv is relatively small (second supply amount) and the supply rotation number N is one time (rotation), the supply interval of T/N is 0.75 s, and the supplying screw 31 is rotated at a target speed (1.4 rps) at which the screw is rotated one rotation in 0.71 s, and when the screw is not rotated one rotation in 0.73 s, the image formation is stopped. In the case where the predicted supply amount Sv is relatively large (first supply amount) and the supply rotation number N is two times, the supply time of T/N is 0.375 s, and the supplying screw 31 is rotated at a target speed (3.0 rps) at which the screw is rotated one rotation in 0.335 s from a leading end of the image, and when the screw is not rotated one rotation in 0.355 s, the image formation is stopped. Then second rotation is started at a time of 0.375 s, and when the screw is not rotated one rotation in 0.355 s after the start, the image formation is stopped.

That is, the controller 11 sets the predicted supply amount Sv of the toner supplied to the developer container 21, on the basis of the image information. Then, in the case where the predicted supply amount Sv is the first supply amount, the controller 11 causes the supplying screw 3) to rotate at a first speed (for example, 3.0 rps). Further, in the case where the predicted supply amount Sv is the second supply amount smaller than the first supply amount, the controller 11 causes the supplying screw 31 to rotate at a second speed (for example, 1.4 rps) slower than the first speed.

In this embodiment, the suppliable time T is, for example, a time from a start of development of the electrostatic latent image into the toner image until development of a subsequent electrostatic latent image into the toner image is started. The controller 11 executes supply of the developer to the developer container 21 on the basis of a single predicted supply amount Sv in a period from the start of the development of the electrostatic latent image into the toner image until the development of the subsequent electrostatic latent image into the toner image is started. An interval from the start of the image formation to subsequent image formation is the suppliable time T(s), and in the case where the supply rotation number is N (time(s)), the supplying screw 31 is rotated at a speed in (T−0.04N)/N(s), and drive of the supplying screw 31 is started every T/N(s). Further, when the supplying screw 31 is not rotated in T−0.04N)/N+0.02 (s), the image formation is stopped. Further, in the case where the supply amount can be estimated from image data in subsequent image formation and later image formation at a point of time of certain image formation, the toner supply may also be carried out as a block of the estimated section. For example, in the case where when two A4 size sheets are passed, the toner content value is substantially equal to the target value and the supply rotation number N of a total of the two sheets can be estimated as one time from the image data, the toner may also be supplied in a condition that a time corresponding to passing of two sheets is the suppliable time T of 1.5 s which is an image formation interval and that the supply rotation number N is one time. However, in this embodiment, there is no effect even when the toner is supplied in a time not less than 1.4 s, and therefore, the supply time has an upper limit of 1.4 s. Incidentally, as regards the suppliable time T, not only the interval of the image formation but also a driving time of the developing device in pieces of control and the like may also be taken into consideration.

Next, in the image forming apparatus 1 of this embodiment, a procedure for supplying the toner to the developer container 21 will be described along a flowchart shown in FIG. 6. The controller 11 discriminates whether or not a print job exists (step S1). In the case where the controller 11 discriminated that the print job did not exist, the controller 11 ends the process. In the case where the controller 11 discriminated that the print job existed, the controller 11 acquires the predicted supply amount Sv, the target toner content Tt, the suppliable time T, a detected toner content Ts during the last image formation, and a frequency Sr during the last image formation (step S2). In this embodiment, in the case of the A4-size sheet, T=0.65 s, and in the case of the A3-size sheet, T=1.3 s. Further, the controller 11 calculates the supply rotation number N on the basis of the acquired values of the predicted supply amount Sv, the target toner content Tt, the detected toner content Ts during the last image formation and the frequency Sr during the image formation (step S3).

The controller 11 starts the image formation (step S4), and then discriminates whether or not the supply rotation number N is 1 or more (step S5). In the case where the controller 11 discriminated that the supply rotation number N is not 1 or more, the process goes back to the step S1. In the case where the controller 11 discriminated that the supply rotation number N is 1 or more, the controller 11 causes the supplying screw 31 to rotate at a rotational speed for the supply time of (T−0.04N)/N(s) at the supply interval of T/N(s) from a leading end of the image, so that the toner supply is executed (step S6).

Then, the controller 11 discriminates whether or not the supply time is (T−0.04N)/N+0.02 (s) or more (step S7). In the case where the controller 11 discriminated that the supply time is (T−0.04N)/N+0.02 (s) or more, the controller 11 ends the process. In the case where the controller 11 discriminated that the supply time is not (T−0.04N)/N+0.02 (s) or more, the controller 11 discriminates whether or not an execution rotation number (execution number of times of rotation) n=the supply rotation number N is satisfied (step S8). In the case where the controller 11 discriminated that the execution rotation number n=the supply rotation number N is not satisfied, the controller 11 causes the supplying screw 31 to supply the toner by rotation of the supplying screw 31 at the rotational speed for the supply time of (T−0.04N)/N(s) at the supply interval of T/N(s) again (step S6), and the controller 11 repeats this operation until the execution rotation number n=the supply rotation number N is satisfied. In the case where the controller 11 discriminated that the execution rotation number n=the supply rotation number N is satisfied, the controller 11 regards the toner supply as being ended, so that the process goes back to the step S1.

As described above, according to the image forming apparatus 1 of this embodiment, when the developer is supplied to the developer container 21 by rotating the supplying screw 31 under the control of the controller 11, the occurrence of the image contamination resulting from the agglomerated toner passed through the supplying screw 31 can be suppressed. That is, the toner supply amount per unit time is decreased and the supplying toner contacts the carrier in the developer, and thus the agglomerated toner is easily broken (loosened), so that the image contamination resulting from the agglomerated toner can be suppressed.

<Effect of this Embodiment>

Here, as an effect of this embodiment, the case of continuous image formation (sheet passing) of A3-size sheets with a print ratio (image ratio) of 7% will be described. However, for simplicity of description, the toner content is constant and correction by the toner content is not carried out. The A3-size sheet is used, and therefore, a maximum number of times of suppliable rotation is 4 times (turns), but the print ratio is 7%, so that the amount of the toner consumed at a time is about 0.042 g and thus the toner is supplied one time per 6 sheets.

(Comparison Example 1)

In this comparison example, the toner was supplied for 0.28 s from a leading end of the sheet. At this time, from the above-described study, there is a possibility that 0.4 particle of the image contamination per 100 rotations (turns) generates. That is, when 6,000 A3-size sheets are subjected to sheet passing, there is a possibility that 4 particles of the image contamination generates at the maximum.

(Embodiment 1)

In this embodiment, the supplying screw 31 was rotated for 1.36 s in a condition that the sheet size is 420 mm, the suppliable time T which is the image formation interval at the sheet interval of 30 mm is 1.4 s, and the supply rotation number N is one time (turn). At this time, from the above-described study, the occurrence of the image contamination was able to be suppressed to a level of about 0.3 particle per 100 rotations. That is, when 6,000 A4-size sheets are subjected to sheet passing, the occurrence of the image contamination can be suppressed to a level of 3 sheets at the maximum.

As another example, the case of continuous image formation (sheet passing) of A3-size sheets with a print ratio 84% will be described. However, for simplicity of description, the toner content is constant and correction by the toner content is not carried out. The A3-size sheet is used, and therefore, a maximum number of times of suppliable rotation is 4 times (turns), but the print ratio is 84%, so that the amount of the toner used at a time is about 0.50 g and thus the toner is supplied two times per (one) sheet.

(Comparison Example 2)

In this comparison example, the toner was supplied two times in 0.28 s from a leading end of the sheet. At this time, from the above-described study, there is a possibility that 0.45 particle of the image contamination per 100 rotations (turns) generates. That is, when 6,000 A3-size sheets are subjected to sheet passing, there is a possibility that 54 sheets of the image contamination occur at the maximum.

(Embodiment 2)

In this embodiment, the supplying screw 31 was rotated for 0.63 s in a condition that the sheet size is 420 mm, the suppliable time T which is the image formation interval at the sheet interval of 30 mm is 1.4 s, and the supply rotation number N is two times (turns). At this time, from the above-described study, the occurrence of the image contamination was able to be suppressed to a level of 0.35 particle per 100 rotations. That is, when 6,000 A4-size sheets are subjected to sheet passing, the occurrence of the image contamination can be suppressed to a level of 42 sheets at the maximum.

As described above, in this embodiment, in the case of an image with a first image ratio (at least 84%) of 100% (i.e., a solid image), the toner supply number becomes maximum, and therefore, the number of times of rotation in which the supplying screw 31 rotates in a predetermined time becomes maximum. As a result, the rotational speed (first rotational speed) also becomes maximum. On the other hand, in the case where a second image ratio is not more than a predetermined value (for example, not more than 7%), the number of times of rotation in which the supplying screw 31 rotates in the predetermined time is smaller than that in the case of the image with the image ratio of 100%. As a result, the rotational speed (second rotational speed) is smaller (slower) than the first rotational speed.

A single supply time (per one rotation) may be increased continuously or stepwisely relative to the ratio T/N of the toner supply rotation number T to the suppliable time T (i.e., even when the ratio T/N is somewhat different, the single supply time may be the same in some cases). Further, the single supply time may have an upper limit. Particularly, in a region where there is no effect even when the single supply time is increased, provision of the upper limit has an advantage that a control range of the motor can be limited.

<Second Embodiment>

Next, the Second Embodiment of the present invention will be specifically described with reference to FIGS. 7-9. In this embodiment, a constitution is different from that in the First Embodiment in that the controller 11 sets the rotational speed of the supplying screw 31 on the basis of a detection result of the temperature sensor 64. However, other constitutes are similar to those in the First Embodiment, and therefore, elements of the constitutions are represented by the same reference numerals or symbols and will be omitted from detailed description.

In this embodiment, in order to meet demands for speed-up and high stability, a supplying method in which a temperature in the developing device 20 or in the neighborhood of the developing device 20 is detected and on the basis of a detection result, the rotational speed of the supplying screw 31 is changed will be described. The controller 11 causes the temperature sensor 64 to detect the temperature in the neighborhood of the developing device 20. In this embodiment, this detection temperature refers to the temperature of the developing device 20.

In recent years, with the demand for the speed-up, a stirring time after the toner supply becomes short, so that a risk of image non-uniformity and the image contamination increases. Further, in the market of PP (production printing), with requirement of a continuous operation for a long time such that PPH (print number per hour) is an index, a risk of the image contamination due to a change in toner flowability resulting from temperature rise in the image forming apparatus increases. In order to avoid the risk, in an environment (for example, 25° C.) principally used in the PP market in general, there is a liability that the toner supply amount changes when the toner supply time is changed and thus in-plane color tint non-uniformity and a change in color tint and the like which are caused due to a variation in toner supply amount occur. On the other hand, it also turns out that during temperature rise (for example, 38° C.), the flowability of the supplying toner changes and the toner is liable to agglomerate and thus even when the rotational speed of the supplying screw 31 changes, a degree of a variation in toner supply amount becomes small. Here, a relationship between the supply time and the supply amount in the respective temperature environments are shown in Table 1. As shown in Table 1, it is understood that compared with the case where the temperature is low, in the case where the temperature is high, the supply amount is substantially unchanged relative to the supply time.

TABLE 1

| | | ORST*[1] (msec) | | | |
|---|---|---|---|---|---|
| | | 250 | 500 | 750 | 1000 |
| Supply Amount (mg) | 25° C. | 240 | 270 | 310 | 360 |
| | 38° C. | 240 | 244 | 248 | 256 |

*[1]"ORST" is a one rotation supply time.

Further, similarly as described above with reference to part (a) of FIG. 5, the occurrence frequency of the image contamination in the case where the toner is continuously supplied is converted into the number of generation of particles per supply amount corresponding to 100 rotations (times of rotation), and is shown in part (a) of FIG. 7 for each of the temperatures of the developing device 20. As shown in part (a) of FIG. 7, also in this case, irrespective of the temperatures of the developing device 20, it is understood that the occurrence frequency is lower in divided supply than in continuous supply, and it is also understood that the occurrence frequency is higher at the high temperature of the developing device 20 than at the low temperature of the developing device 20.

Further, a correlation between the temperature of the developing device 20 and the image contamination occurrence frequency is shown in part (b) of FIG. 7. As shown in part (b) of FIG. 7, it is understood that when the temperature of the developing device 20 becomes high, the image contamination occurrence frequency abruptly increases. Further, a correlation between the one rotation supply time and the image contamination occurrence frequency is shown in part (a) of FIG. 8. As shown in part (a) of FIG. 8, it is understood that the image contamination occurrence frequency lowers with a longer one rotation supply time and that the image contamination occurrence frequency is higher at the high temperature of the developing device 20 than at the low temperature of the developing device 20. Therefore, for example, in a normal environment of 25° C., in order to stabilize the toner supply amount, it is preferable that irrespective of the toner supply amount, the toner is supplied in the same time period. On the other hand, in the case where the temperature of the developing device 20 is high such that the risk of the toner content increases, it is preferable that a balance of the image contamination with the in-place color tint non-uniformity or the change in color that is achieved by slowly supplying the toner in the suppliable time to the extent possible.

In this embodiment, the toner supply amount per unit time is changed by changing a rotational speed of the supplying screw 31 on the basis of a detection result of the temperature of the developing device 20 or in the neighborhood of the developing device 20, a necessary toner supply rotation number (the number of times of rotation for toner supply) N and a suppliable time T. Specifically, only when the supply amount is stable relative to the supply time, the toner is supplied by taking a time so that the supplied toner is dispersed to the extent possible while increasing the rotational speed to not less than a speed at which the supplying screw 31 can be rotated the toner supply rotation number N in the suppliable time T. That is, when the temperature reaches a certain temperature, on the basis of the suppliable time T, the rotational speed of the supplying screw 31 is changed, so that the supply amount per unit time is changed.

Here, by a result of study by the present inventors, it turned out that in the case where the temperature of the developing device 20 becomes not less than 38° C., even when the rotational speed of the supplying screw 31 is changed, a variation in supply amount decreases and a risk of a remarkable increase in image contamination occurrence frequency increases. This would be considered because a depositing force among toner particles is abruptly changed by a change in viscosity of the toner. Therefore, in this embodiment, in the case where the temperature of the developing device 20 is not less than 38° C. as a threshold temperature, the rotational speed of the supplying screw 31 is changed. However, the threshold temperature can be changed depending on a difference in the toner used, a supplying method, one rotation supply amount or the like. In the case where the temperature of the developing device 20 is not less than 38° C., when a calculated suppliable time is T and the supply rotation number is an integer N, the supplying screw 31 is rotated at a speed of one rotation (turn) in a time of T/N or less. Further, in the case where the supply rotation number is an integer M smaller than the integer N, the supplying screw 31 is controlled so as to be rotated at a speed of one rotation in a time of T/N or more and T/M or less. Incidentally, in the case where the controller 11 detects that the temperature of the developing device 20 is not less than 38° C., the toner supply is executed by the process similar to the process in the First Embodiment, and therefore, the process will be omitted from detailed description.

Next, in this embodiment, in the case where the temperature of the developing device 20 is not less than 38° C., similarly as in the First Embodiment, the case where the toner is supplied not only during the image formation but also in the sheet interval will be described. The sheet interval varies in general depending on various pieces of control and the like, but in this embodiment, the case where the sheet interval is constant in continuous sheet passing will be described. The passing time of the A4-size sheet is 0.65 s, and there is an interval of 0.75 s at a leading end of the sheet even in the case of continuous image formation in which the sheet interval of 30 mm is taken into consideration. In this embodiment, an error threshold in the case where the supplying screw 31 is not rotated at a predetermined speed due to a load on the supplying screw 31 is set at a time 0.02 s before the supply interval, and a time for one rotation at a target speed is set at a time 0.02 s before the error threshold. That is, in the case where the predicted supply amount Sv is relatively small (second supply amount) and the supply rotation number N is one time (rotation), the supply interval of T/N is 0.75 s, and the supplying screw 31 is rotated at a target speed (1.4 rps) at which the screw is rotated one rotation in 0.71 s, and when the screw is not rotated one rotation in 0.73 s, the image formation is stopped. In the case where the predicted supply amount Sv is relatively large (first supply amount) and the supply rotation number N is two times, the supply time of T/N is 0.375 s, and the supplying screw 31 is rotated at a target speed (3.0 rps) at which the screw is rotated one rotation in 0.335 s from a leading end of the image, and when the screw is not rotated one rotation in 0.355 s, the image formation is stopped. Then second rotation is started at a time of 0.375 s, and when the screw is not rotated one rotation in 0.355 s after the start, the image formation is stopped.

That is, the controller 11 sets the predicted supply amount Sv of the toner supplied to the developer container 21, on the basis of the image information. Then, when the detection result of the temperature sensor 64 is not less than the threshold temperature, in the case where the predicted supply amount Sv is the first supply amount, the controller 11 causes the supplying screw 3) to rotate at a first speed (for example, 3.0 rps). Further, when the detection result of the temperature sensor 64 is not less than the threshold temperature, in the case where the predicted supply amount Sv is the second supply amount smaller than the first supply amount, the controller 11 causes the supplying screw 31 to rotate at a second speed (for example, 1.4 rps) slower than the first speed.

Next, in the image forming apparatus 1 of this embodiment, a procedure for supplying the toner to the developer container 21 will be described along a flowchart shown in FIG. 9. The controller 11 discriminates whether or not a print job exists (step S10). In the case where the controller 11 discriminated that the print job did not exist, the controller 11 ends the process. In the case where the controller 11 discriminated that the print job existed, the controller 11 discriminates whether or not the temperature of the developing device 20 is 38° C. or more (step S11).

In the case where the controller 11 discriminates that the temperature of the developing device 20 is not 38° C. or more, a normal toner supplying operation is executed without changing the rotational speed of the supplying screw 31 (step S12). On the other hand, in the case where the controller 11 discriminated that the temperature of the developing device 20 is 38° C. or more, the controller 11 acquires the predicted supply amount Sv, the target toner content Tt, the suppliable time T, a detected toner content Ts during the last image formation, and a frequency Sr during the last image formation (step S13). Further, the controller 11 calculates the supply rotation number N on the basis of the acquired values of the predicted supply amount Sv, the target toner content Tt, the detected toner content Ts during the last image formation and the frequency Sr during the image formation (step S14).

The controller 11 starts the image formation (step S15), and then discriminates whether or not the supply rotation number N is 1 or more (step S16). In the case where the controller 11 discriminated that the supply rotation number N is not 1 or more, the process goes back to the step S10. In the case where the controller 11 discriminated that the supply rotation number N is 1 or more, the controller 11 causes the supplying screw 31 to rotate at a rotational speed for the supply time of (T−0.04N)/N(s) at the supply interval of T/N(s) from a leading end of the image, so that the toner supply is executed (step S17).

Then, the controller 11 discriminates whether or not the supply time is (T−0.04N)/N+0.02 (s) or more (step S18). In the case where the controller 11 discriminated that the supply time is (T−0.04N)/N+0.02 (s) or more, the controller 11 ends the process. In the case where the controller 11 discriminated that the supply time is not (T−0.04N)/N+0.02 (s) or more, the controller 11 discriminates whether or not an execution rotation number (execution number of times of rotation) n=the supply rotation number N is satisfied (step S19). In the case where the controller 11 discriminated that the execution rotation number n=the supply rotation number N is not satisfied, the controller 11 causes the supplying screw 31 to supply the toner by rotation of the supplying screw 31 at the rotational speed for the supply time of (T−0.04N)/N(s) at the supply interval of T/N(s) again (step S17), and the controller 11 repeats this operation until the execution rotation number n=the supply rotation number N is satisfied. In the case where the controller 11 discriminated that the execution rotation number n=the supply rotation number N is satisfied, the controller 11 regards the toner supply as being ended, so that the process goes back to the step S10.

As described above, according to the image forming apparatus 1 of this embodiment, when the developer is supplied to the developer container 21 by rotating the supplying screw 31 under the control of the controller 11, the occurrence of the image contamination resulting from the agglomerated toner passed through the supplying screw 31 can be suppressed. That is, the toner supply amount per unit time is decreased and the supplying toner contacts the carrier in the developer, and thus the agglomerated toner is easily broken (loosened), so that the image contamination resulting from the agglomerated toner can be suppressed.

Further, in the case where the temperature of the developing device 20 is less than 38° C., the supply amount varies depending on one rotation time of the supplying screw 31, and therefore, in consideration of the in-plane color tint non-uniformity and the change in color tint, the supplying operation is carried out without changing the rotation time of the supplying screw 31. On the other hand, in the case where the temperature of the developing device 20 is 38° C. or more, the risk of the image contamination increases, and even when the rotation time of the supplying screw 31 is changed, a degree of the change in supply amount decreases. For this reason, in consideration that the in-plane color tint non-uniformity and the change in color that do not readily occur, the supplying operation is carried out so as to decrease the supply amount per unit time to the extent possible. As a result, even when the image forming apparatus 1 increases in temperature during continuous operation thereof for a long time, the image contamination can be suppressed while suppressing the in-plane color tint non-uniformity and the change in color tint.

(Embodiment 3)

Here, as Embodiment 3, the case of continuous image formation (sheet passing) of A3-size sheets for 5 hours with respect to an original with a print ratio (image ratio) of 7% will be described. The number of sheets outputted per minute is 50 sheets and the number of sheets in the continuous sheet passing for 5 hours is 15,000 sheets. However, for simplicity of description, the toner content is constant and correction by the toner content is not carried out. The A3-size sheet is used, and therefore, a maximum number of times of suppliable rotation is 4 times (turns), but the print ratio is 7%, so that the amount of the toner consumed at a time is about 0.042 g and thus the toner is supplied one time per 6 sheets.

In the case where the temperature of the developing device 20 is less than 38° C., the toner was supplied for 0.28 s from a leading end of the sheet. At this time, from the above-described study, 0.4 particle of the image contamination per 100 rotations (turns) generates. When the developing device 20 is operated for 5 hours at the temperature of less than 38° C., 15,000 A3-size sheets are passed, so that 10 particles of the image contamination generates at the maximum, but such a degree falls within an allowable range from a balance with production efficiency or the like.

Here, as shown in part (b) of FIG. 8, the temperature of the developing device 20 exceeds 38° C. from after a lapse of about 3 hours of the start of the continuous sheet passing. In a state of 38° C., from the above-described study, 0.49 particle of the image contamination per 100 rotations generates and therefore, 11 particles of the image contamination generates at the maximum during the continuous sheet passing for 5 hours, so that compared with the case where there is no temperature rise, generation probability increases by about 10%. Further, in the PP market, the in-place color tint non-uniformity and the change in color tint are most important items, and thus there is a need to suppress a variation in supply to the extent possible, and therefore, it is not suitable that the supply amount changes by 10%.

Therefore, in the case where the temperature of the developing device 20 is 38° C. or more, the supplying screw 31 was rotated for 1.36 s in a condition that the sheet size is 420 mm, the suppliable time T which is the image formation interval at the sheet interval of 30 mm is 1.4 s, and the necessary supply rotation number N is one time (turn). At this time, from the above-described study, the occurrence of the image contamination was able to be suppressed to a level of about 0.35 particle per 100 rotations. That is, when 15,000 A4-size sheets are subjected to sheet passing, the in-plane color tint non-uniformity and the change in color tint was able to be suppressed to the extent possible while suppressing the occurrence of the image contamination to a level of about 10 particles at the maximum.

(Embodiment 4)

Next, as Embodiment 4, the case of continuous image formation (sheet passing) of A3-size sheets for 5 hours with respect to an original with a print ratio (image ratio) of 84% will be described. The number of sheets outputted per minute is 50 sheets and the number of sheets in the continuous sheet passing for 5 hours is 15,000 sheets. However, for simplicity of description, the toner content is constant and correction by the toner content is not carried out. The A3-size sheet is used, and therefore, a maximum number of times of suppliable rotation is 4 times (turns), but the print ratio is 84%, so that the amount of the toner used at a time is about 0.50 g and thus the toner is supplied two times per one sheet.

In the case where the temperature of the developing device 20 is less than 38° C., the toner was supplied two times in 0.28 s from a leading end of the sheet. At this time, from the above-described study, 0.45 particle of the image contamination per 100 rotations (turns) generates. When the developing device 20 is operated for 5 hours at the temperature of less than 38° C., 15,000 A3-size sheets are passed, so that 135 sheets of the image contamination generates at the maximum. Similarly as when the print ratio of 7%, the temperature of the developing device 20 exceeds 38° C. from after a lapse of about 3 hours of the start of the continuous sheet passing, and 0.55 particle of the image contamination per 100 rotations generates and in consideration of this, there is a liability that 147 sheets of the image contamination generates at the maximum when the 15,000 A3-size sheets are subjected to the sheet passing.

Therefore, in the case where the temperature of the developing device 20 is 38° C. or more, the supplying screw 31 was rotated for 0.63 s in a condition that the sheet size is 420 mm, the suppliable time T which is the image formation interval at the sheet interval of 30 mm is 1.4 s, and the necessary supply rotation number N is two times (turns). At this time, from the above-described study, in the case where the temperature of the developing device 20 is 38° C. or more and the toner is supplied two times per sheet, the occurrence of the image contamination was able to be suppressed to a level of about 0.42 particle per 100 rotations. Therefore, when the 15,000 A4-size sheets are subjected to sheet passing, the in-plane color tint non-uniformity and the change in color tint was able to be suppressed to the extent possible while suppressing the occurrence of the image contamination to a level of about 131 particles at the maximum.

<Third Embodiment<

Next, the Third Embodiment of the present invention will be specifically described with reference to FIGS. 10 and 11. In this embodiment, a constitution is different from that in the First Embodiment in that the toner is supplied at a supplying speed which is described below and which is a predetermined speed or less in a manner that timing of a subsequent developing step is delayed depending on the supply rotation number N. However, other constitutes are similar to those in the First Embodiment, and therefore, elements of the constitutions are represented by the same reference numerals or symbols and will be omitted from detailed description.

As described above in the First Embodiment, in the case where in the continuous sheet passing, the supplying time is the same as the sheet passing time and the maximum supply rotation number and the supply rotation number N are equal to each other, the supplying speeds in this embodiment and the comparison example were not substantially different from each other. On the other hand, in the First Embodiment, such a case that the print ratio is high is small in number, and therefore, priority is given to productivity and the toner supply is carried out. In this embodiment, the subsequent developing step is delayed depending on the supply rotation number N with respect to the maximum number of times of supply changing depending on the sheet size, and the toner is supplied at the supplying speed which is not more than a predetermined speed, so that the image contamination resulting from the supplying toner is suppressed.

First, the case where the toner is supplied also in the sheet interval in the First Embodiment will be described again for comparison. The sheet interval varies in general depending on various pieces of control and the like, but in this embodiment, the case where the sheet interval is constant in continuous sheet passing will be described. The passing time of the A4-size sheet is 0.65 s, and there is an interval of 0.75 s at a leading end of the sheet even in the case of continuous image formation in which the sheet interval of 30 mm is taken into consideration. In this embodiment, an error threshold in the case where the supplying screw 31 is not rotated at a predetermined speed due to a load on the supplying screw 31 is set at a time 0.02 s before the supply interval, and a time for one rotation at a target speed is set at a time 0.02 s before the error threshold. That is, in the case where the predicted supply amount Sv is relatively small (second supply amount) and the supply rotation number N is one time (rotation), the supplying screw 31 is rotated at a target speed (1.4 rps) at which the screw is rotated one rotation in 0.71 s, and when the screw is not rotated one rotation in 0.73 s, the image formation is stopped. In the case where the predicted supply amount Sv is relatively large (first supply amount) and the supply rotation number N is two times, the supplying screw 31 is rotated at a target speed (3.0 rps) at which the screw is rotated one rotation in 0.335 s from a leading end of the image, and when the screw is not rotated one rotation in 0.355 s, the image formation is stopped. Then second rotation is started at a time of 0.375 s, and when the screw is not rotated one rotation in 0.355 s after the start, the image formation is stopped.

In general, an interval from the start of the image formation to subsequent image formation is the suppliable time T(s), and in the case where the supply rotation number is N (time(s)), the supplying screw 31 is rotated at a speed in (T−0.04N)/N(s), and the drive of the supplying screw 31 is started every T/N(s). Further, when the supplying screw 31 is not rotated in (T−0.04N)/N+0.02 (s), the image formation is stopped. In the case where the toner is supplied also in the sheet interval during the continuous sheet passing of the A4-size sheets, the supplying screw 31 is driven so as to rotate one rotation in 0.71 s when the supply rotation number N is one time, and when the supply rotation number is two times, the supply of the toner is repeated two times so that the supplying screw 31 is rotated one rotation in 0.335 s. For this reason, when the print ratio is not less than 84% over the continuous sheet passing of the A4-size sheets, a single (one) supply rotation time is 0.355 s, and when compared with the case where the supply rotation number N is one (time), a state in which the image contamination due to the supplying toner is liable to occur generates.

Therefore, in this embodiment, a one rotation supply time tn is changed on the basis of the suppliable time T and the supply rotation number N, so that the rotational speed of the supplying screw 31 is changed. Then, in the case where the one rotation supply time tn is calculated as being less than a predetermined time (threshold tx), the toner is supplied so that the one rotation supply time tn is the predetermined time (threshold tx), and the supply amount per unit time is changed so that a subsequent developing step is started after the supply rotation number N is completely ended. That is, in the case where the supply time is not less than the predetermined time, the one rotation supply time is the predetermined time and the subsequent image formation is delayed, and the subsequent developing step is started after the end of the supply rotation number N. That is, the rotational speed of the supplying screw 31 is changed to a speed so that the supplying screw 31 can be rotated one rotation in a calculated supply time, so that the toner is supplied by using a time so that the supply of the toner is carried out in a division manner to the extent possible.

In this embodiment, the single supply time tn is calculated similarly as in the First Embodiment and the threshold tx of the single supply time tn is 0.6 s. In this condition, this embodiment will be described. However, 0.02 s of an error discrimination time and 0.02 s of a time to subsequent toner supply start are provided. That is, in the case where the single supply time tn is calculated as being 0.6 s or less, the toner is supplied so that the supplying screw 31 rotates one rotation in 0.6 s, and in the case where the supplying screw 31 does not rotate one rotation in 0.62 s, the image formation is stopped. Supply timing or subsequent developing step start timing in the case where there is a need to supply the toner plural time are 0.64 s from a start of the drive of the supplying screw 31 for supplying the toner. As the threshold tx of the single supply time tn, from part (b) of FIG. 5, a value at which an image contamination suppressing effect is large when the increase in supply time is taken into consideration was selected. The image contamination occurrence frequency and productivity change depending on the threshold tx of the single supply time tn, and therefore, the threshold tx may desirably be optimized depending on a characteristic and a normal allowable range of the developing device 20. Further, there is also a method in which setting of the threshold tx can be appropriately changed in consideration of the contents of use of the image forming apparatus 1.

In this embodiment, in the case where the supply rotation number N is one (time) in the A4-size sheet passing, the supplying screw 31 is rotated at a speed (1.4 rps) in which the supplying screw 31 rotates in 0.71 s, and when the supplying screw 31 does not rotate one rotation in 0.73 s, the image formation is stopped (first mode). This operation is similar to the operation in the First Embodiment. On the other hand, in the case where the supply rotation number N is two (times), in the calculation in the First Embodiment, the single supply time is shorter than the threshold tx, and therefore, in this embodiment, the single supply time tn is the threshold tx=0.6 s (second mode). The supplying screw 31 is rotated at a target speed at which the supplying screw 31 rotates one rotation in 0.6 s from a leading end of the image, and when the supplying screw 31 does not rotate one rotation in 0.62 s, the image formation is stopped. At timing of 0.64 s, second rotation of the supplying screw 31 is started and when the supplying screw 31 does not rotate one rotation in 0.62 s from the start of the second rotation, the image formation is stopped. Subsequent image formation is started after a lapse of 1.28 s from the start of the first toner supply, so that compared with the First Embodiment, the timing is delayed by 0.53 s.

That is, on the basis of image information, the controller 11 sets the predicted supply amount Sv of the toner to the developer container 21. With respect to the predicted supply amount Sv, the controller 11 is capable of carrying out operations in the first and second modes different in rotational speed of the supplying screw 31 in a switching manner. The controller 11 calculates the supply time tn per (one) rotation with respect to the supply rotation number N in the suppliable time T. Then, in the case where the supply time tn is not less than the threshold, i.e., not less than tx, the controller 11 selects the operation in the first mode, and causes the supplying screw 31 to rotate at a rotational speed such that the supplying screw 31 rotates one rotation in the supply time tn. Further, in the case where the supply time tn is less than the threshold, i.e., less than tx, the controller 11 selects the operation in the second mode, and causes the supplying screw 31 to rotate at a rotational speed such that the supplying screw 31 rotates one rotation in the time of the threshold tx.

In general, an interval from the start of the image formation to subsequent image formation is the suppliable time T(s), and in the case where the supply rotation number is N (time(s)), the supply time tn is calculated from (T−0.04N)/N(s). In the case where the supply time tn is larger than the threshold tx, the supplying screw 31 is rotated at a speed such that the supplying screw 31 rotates one rotation in the supply time tn, and the drive of the supplying screw 31 is started every T/N(s). Further, when the supplying screw 31 is not rotated in (T−0.04N)/N+0.02 (s), the image formation is stopped.

Next, in the image forming apparatus 1 of this embodiments, a procedure for supplying the toner to the developer container 21 will be described along a flowchart shown in FIGS. 10 and 11. The controller 11 discriminates whether or not a print job exists (step S20). In the case where the controller 11 discriminated that the print job did not exist, the controller 11 ends the process. In the case where the controller 11 discriminated that the print job existed, the controller 11 acquires the predicted supply amount Sv, the target toner content Tt, the suppliable time T, a detected toner content Ts during the last image formation, and a frequency Sr during the last image formation (step S21). Further, the controller 11 calculates the supply rotation number N on the basis of the acquired values of the predicted supply amount Sv, the target toner content Tt, the detected toner content Ts during the last image formation and the frequency Sr during the image formation (step S22).

Further, on the basis of the suppliable time T and the supply rotation number N, the controller 11 calculates the single supply time tn (step S23).

The controller 11 starts the image formation (step S24), and then discriminates whether or not the supply rotation number N is 1 or more (step S25). In the case where the controller 11 discriminated that the supply rotation number N is not 1 or more, the process goes back to the step S20. In the case where the controller 11 discriminated that the supply rotation number N is 1 or more, the controller 11 discriminates whether or not the single supply time tn is the threshold tx or more (step S26).

In the case where the controller 11 discriminated that the single supply time tn is the threshold tx or more, the controller 11 causes the supplying screw 31 to rotate at a rotational speed such that the supplying screw 31 rotates one rotation in the supply time tn with the supply interval of tn+0.04 (s) from a leading end of the image, so that the toner supply is executed (step S27, first mode). Then, the controller 11 discriminates whether or not the supply time is tn+0.02 (s) or more (step S28). In the case where the controller 11 discriminated that the supply time is tn+0.02 (s) or more, the controller 11 ends the process. In the case where the controller 11 discriminated that the supply time is not tn+0.02 (s) or more, the controller 11 discriminates whether or not an execution rotation number (execution number of times of rotation) n=the supply rotation number N is satisfied (step S29). In the case where the controller 11 discriminated that the execution rotation number n=the supply rotation number N is not satisfied, the controller 11 causes the supplying screw 31 to supply the toner by rotation of the supplying screw 31 at the rotational speed for the supply time of tn(s) at the supply interval of tn+0.04 (s) again (step S27), and the controller 11 repeats this operation until the execution rotation number n=the supply rotation number N is satisfied. In the case where the controller 11 discriminated that the execution rotation number n=the supply rotation number N is satisfied, the controller 11 regards the toner supply as being ended, so that the process goes back to the step S20.

In the case where the controller 11 discriminated in the step S26 that the single supply time tn is not the threshold tx or more, the single supply time tn is set at the threshold tx, and the process is performed in the following manner. First, the controller 11 causes the supplying screw 31 to rotate at a rotational speed such that the supplying screw 31 rotates one rotation in the supply time tx with the supply interval of tx+0.04 (s) from a leading end of the image, so that the toner supply is executed (step S30, second mode). Then, the controller 11 discriminates whether or not the supply time is tx+0.02 (s) or more (step S31). In the case where the controller 11 discriminated that the supply time is tx+0.02 (s) or more, the controller 11 ends the process. In the case where the controller 11 discriminated that the supply time is not tx+0.02 (s) or more, the controller 11 discriminates whether or not an execution rotation number (execution number of times of rotation) n=the supply rotation number N is satisfied (step S32). In the case where the controller 11 discriminated that the execution rotation number n=the supply rotation number N is not satisfied, the controller 11 causes the supplying screw 31 to supply the toner by rotation of the supplying screw 31 at the rotational speed for the supply time of tx(s) at the supply interval of tx+0.04 (s) again (step S30), and the controller 11 repeats this operation until the execution rotation number n=the supply rotation number N is satisfied. In the case where the controller 11 discriminated that the execution rotation number n=the supply rotation number N is satisfied, the controller 11 regards the toner supply as being ended, so that the process goes back to the step S20.

As described above, according to the image forming apparatus 1 of this embodiment, when the developer is supplied to the developer container 21 by rotating the supplying screw 31 under the control of the controller 11, the occurrence of the image contamination resulting from the agglomerated toner passed through the supplying screw 31 can be suppressed. That is, the toner supply amount per unit time is decreased and the supplying toner contacts the carrier in the developer, and thus the agglomerated toner is easily broken (loosened), so that the image contamination resulting from the agglomerated toner can be suppressed.

Here, for example, the case where the image with the print ratio of 98% is continuously formed on 6 A4-size sheets and then the image with a print ratio of 0% is continuously formed on 94 A4-size sheet will be described.

In this case, in the First Embodiment in which priority is given to the production efficiency, an operation in which the toner is supplied for 5 sheets so that the supplying screw 31 rotates one rotation in 0.71 s and then the toner is supplied for 1 sheet so that the supplying screw 31 rotates one rotation in 0.355 s is repeated two times. When the toner is supplied so that the supplying screw 31 rotates one rotation in 0.71 s, about 0.32 particle/100 rotations of the image contamination generates, and when the toner is supplied so that the supplying screw 31 rotates two rotations in 0.335 s, about 0.43 particle/100 rotations of the image contamination generates, and therefore, when this job is repeated ten times, 25 particles of the image contamination generate at the maximum. On the other hand, in this embodiment, an operation in which the toner is supplied for 5 sheets so that the supplying screw 31 rotates one rotation in 0.71 s and then the toner is supplied for 1 sheet so that the supplying screw 31 rotates one rotation in 0.6 s is repeated two times. When the toner is supplied so that the supplying screw 31 rotates one rotation in 0.71 s, about 0.32 particle/100 rotations of the image contamination generates, and when the toner is supplied so that the supplying screw 31 rotates two rotations in 0.6 s, about 0.325 particle/100 rotations of the image contamination generates, and therefore, when this job is repeated ten times, 22 particles of the image contamination generate at the maximum.

This effect is improved by increasing the threshold tx, and therefore, the threshold tx is set at an appropriate value in view of a balance between the productivity and the image contamination.

Further, this effect is estimation of the image contamination which can occur at the maximum, and even when the agglomerated toner is deposited on the drum in a non-sheet passing range, the agglomerated toner is not deposited on the sheet, and therefore, the number of particles of the image contamination is different depending on a sheet passing region. As in this embodiment, in the case where the single supply time is smaller than the threshold and the toner is supplied in the supply time of the threshold, the subsequent developing step is delayed, and therefore, the agglomerated toner is deposited on the drum in the non-image region but is not deposited on the sheet (paper). Further, the agglomerated toner is broken in some instances in the developing device 20 in a period until the subsequent developing step is started. For this reason, on the sheet, the number of particles of the image contamination is smaller than those described above.

<Fourth Embodiment>

Next, the Fourth Embodiment of the present invention will be specifically described. In this embodiment, a constitution is different from that in the First Embodiment in that as the supply motor 32, a DC motor in which a rotational speed thereof cannot be directly controlled is used and that an actual rotation time is detected by a photo-interrupter. However, other constitutes are similar to those in the First Embodiment, and therefore, elements of the constitutions are represented by the same reference numerals or symbols and will be omitted from detailed description.

In this embodiment, from a viewpoint of an advantage in cost, the DC motor, not a pulse motor, is used. The DC motor is driven depending on an input voltage and a load exerted on the motor. Duty control such that as the input voltage, a certain value is turned on and off in a certain cyclic period is used. A torque exerted on the motor varies depending on an on-ratio, so that the motor rotates at the highest speed when 100%-signal is inputted. Even when the same input signal is sent, an actual rotational speed changes depending on a performance of the motor and the torque exerted on the motor. The torque exerted on the motor is roughly divided into a torque fluctuating due to a run-cut (fluctuation) of screw component parts attached to the motor and a torque fluctuating due to a change in toner amount and toner characteristic at a periphery of the screw component parts. That is, the torque exerted on the motor will be considered based on each of the fluctuation of the screw components and the fluctuation of the toner.

In this embodiment, a control method in which even in the case where the DC motor is used, a desired rotational speed is provided is carried out.

As shown in FIG. 12, there is a method in which a rotation shaft 30*a* of the supplying screw 31 is provided with a flag 31*b* and one rotation of the supplying screw 31 is detected by detecting a phase of the flag 31*b* by a photo-interrupter 31*c*. Further, it is also possible to detect a rotation time of the supplying screw 31 by a detection time of the photo-interrupter 31*c*. For example, when the flag 31*b* overlaps with the photo-interrupter 31*b*, an ON-state is detected. After a start of the drive of the supplying screw 31, the ON-state is detected again and then the drive of the supplying screw 31 is stopped, so that one rotation drive of the supplying screw 31 can be detected. Further, by detecting a time from the start of the drive until the ON-state is detected again, it is possible to detect the rotation time, i.e., the rotational speed.

FIG. 13 is a schematic view of one rotation detection. A time progression is represented along a rightward direction. In FIG. 13, an upper portion represents rotation of the supplying screw rotation shaft 31*a* and the flag 31*b*, and a lower portion represents a progression of a signal in the case where the ON-state is detected when the flag 31*b* overlaps with the photo-interrupter 31*c* and an OFF-state is detected when the flag 31*b* does not overlap with the photo-interrupter 31*c*. When the supplying screw 31 is driven and then the ON-state is detected again, the drive of the supplying screw 31 is stopped, so that the rotation of the supplying screw 31 can be stopped after one rotation of the supplying screw 31.

FIG. 14 shows a relationship between a one rotation time and an input signal in a typical supplying device. In FIG. 14, data is obtained with an increment of 5%-duty with respect to the input signal and remaining data is obtained through linear interpolation. An actual rotational speed varies depending on the fluctuation of the screw component parts and the fluctuation of the toner.

A method in which the supplying speed is controlled by detecting the one rotation time will be described in comparison with the First Embodiment. In the First Embodiment, the toner is supplied in a region including the sheet passing region and the sheet interval, when the A4-size sheet is passed, the sheet passing time in the suppliable time is 0.75 s. In the case where the supply rotation number N is one (time), the supply interval T/N is 0.75 s, so that the supplying screw 31 is driven at a speed (1.6 rps) such that the supplying screw 31 rotates one rotation in 0.71 s. In the case of this embodiment, the DC motor is liable to fluctuate in rotation time thereof, and therefore, relative to an error detection time of 0.73 s, a margin of 0.1 s is ensured and the motor is driven at a speed such that the supplying screw 31 rotates one rotation in 0.63 s. As shown in FIG. 14, when the supplying screw 31 is driven at 75%-duty of the input signal, the supplying screw 31 is driven in 0.46 s shorter than 0.63 s. In such a case, in subsequent drive, by using an input signal with a duty smaller than 75%-duty, the speed can be caused to approach a desired speed. This is true for an opposite case. However, in the case where the rotational speed is excessively slow, there is a liability that the toner supply is not in time, and therefore, there is a need to set an initial input signal at a large value.

Description will be made along a flowchart shown in FIG. 15. A process to the toner supplying method is the same as that in the First Embodiment. The controller 11 discriminates whether or not a print job exists (step S31). In the case where the controller 11 discriminated that the print job did not exist, the controller 11 ends the process. In the case where the controller 11 discriminated that the print job existed, the controller 11 acquires the predicted supply amount Sv, the target toner content Tt, the suppliable time T, a detected toner content Ts during the last image formation, and a frequency Sr during the last image formation (step S32). Further, the controller 11 calculates the supply rotation number N and a target supply time tn on the basis of the acquired values of the predicted supply amount Sv, the target toner content Tt, the detected toner content Ts during the last image formation and the frequency Sr during the image formation (step S33).

The controller 11 starts the image formation (step S34), and then discriminates whether or not the supply rotation number N is 1 or more (step S35). In the case where the controller 11 discriminated that the supply rotation number N is not 1 or more, the process goes back to the step S31. In the case where the controller 11 discriminated that the supply rotation number N is 1 or more, the controller 11 calculates the duty of the motor input signal providing a supply time tn=(T−0.12N)/N(s), and causes the supplying screw 31 to rotate at the supply interval of T/N(s) from a leading end of the image, and when one rotation of the supplying screw 31 is detected (i.e., when the ON-state signal is detected again after the start of the drive), the drive is stopped (step S36).

Then, the controller 11 discriminates whether or not the actual supply time (i.e., the time from the start to an end of the toner supply) is T/N−0.02 (s) or more (step S37). In the case where the controller 11 discriminated that the actual supply time is T/N−0.02 (s) or more, the controller 11 ends the process. In the case where the controller 11 discriminated that the actual supply time is not T/N−0.02 (s) or more, the controller 11 discriminates whether or not an execution rotation number (execution number of times of rotation) n=the supply rotation number N is satisfied (step S38). In the case where the controller 11 discriminated that the execution rotation number n=the supply rotation number N is not satisfied, the controller 11 calculates the duty of the motor input signal providing the supply time tn=(T−0.12N)/N(s). At this time, the last target supply time tn and the actual supply time are compared with each other, so that the duty is determined. Thereafter, the supplying screw 31 is driven at the interval T/N(s) from the last supply, and when one rotation of the supplying screw 31 is detected (i.e., when the ON-state signal is detected again after the start of the drive), the drive is stopped (step S36). This process is repeated until the execution rotation number n=the supply rotation number N is satisfied. In the case where the controller 11 discriminated that the execution rotation number n=the supply rotation number N is satisfied, the controller 11 regards the toner supply as being ended, so that the process goes back to the step S31.

Thus, the number signal is adjusted depending on the detection time, whereby the supply time can be caused to approach the target supply time.

Further, as described in the First Embodiment, when the image forming apparatuses operating in the market are checked, the case where the sheets on which the image with the print ratio of 80% or more is formed are passed on an A4-size basis is 1% or less, and the case where the sheets on which the image with the print ratio of 40% or more in average is formed are passed on the A4-size basis is about 1%. From the result, in most cases, the number of times of supply when two A4-size sheets are passed can be calculated as being one time or less.

As a result, there is also a method in which the number of times of supply is calculated every developing device driving time corresponding to the two A4-size sheets. In that case, the suppliable time is 1.5 s, and in most cases, the number of times of supply is 1 or 0, so that the target supply time tn=1.38 can be set and thus a highly effective supply time can be used. The effect cannot be achieved in the case where the number of times of supply is large similarly as in the case described in the First Embodiment.

<Fifth Embodiment>

Next, the Fifth Embodiment of the present invention will be specifically described. This embodiment is similar to the Fourth Embodiment, and therefore, constituent elements are represented by the same reference numerals or symbols and will be omitted from detailed description.

In this embodiment, the rotational speed gradually approaches a desired rotational speed. However, at first image formation start timing, when the input signal is a typical value, the developing speed is deviated due to the motor performance and the torque exerted on the motor. In this embodiment, control in which a fluctuation of a first speed is decreased by taking the motor performance and a fluctuation of the supplying screw into consideration is carried out.

In this embodiment, in order to take the motor performance and the supplying screw fluctuation into consideration, before the toner is fed by the supplying screw, i.e., before the toner bottle is placed or at timing when the motor and the supplying screw are exchanged due to failure or the like, the single (one) rotation time is detected while changing the input signal, so that a performance of the supplying device into which consideration on the motor performance and the supplying screw fluctuation are taken is detected. On the basis of this detection result, an input signal value when the toner is first supplied is determined.

FIG. 16 shows a relationship between the single rotation time and the input signal in a state that the toner is not placed in the hopper in a typical supplying device. In FIG. 16, data is obtained with an increment of 5%-duty with respect to the input signal and remaining data is obtained through linear interpolation. An actual rotational speed varies depending on the fluctuation of the screw component parts. However, there is no case where in the constitution of this embodiment, the input signal relative to a necessary rotation time is less than 40%, and therefore, the single rotation time was acquired until the input signal was 40%. Further, when the toner is placed in the hopper, the torque increases correspondingly to the toner amount, so that it takes a time which is 1.3 times that in the case of no toner in the hopper in actuality.

Similarly as in the Fourth Embodiment, when the target rotation time is 0.63 s and is converted into the rotation time in a state of no toner, the resultant rotation time is 0.48 s. This can be calculated such that the rotation time corresponds to 69.5%-duty, so that as the first input signal, 70% is used.

A flowchart of control will be described with reference to FIG. 17. A first input signal n is 100% (S41). Drive is started at an input signal of n % (S42). One rotation is detected and a time from the drive start to the detection is acquired (S43). The drive is stopped immediately after the one rotation detection (S44). In order to discriminate whether or not the region is a rotation to be used, whether or not the input signal is 40% is discriminated (S45). In the case of "NO", the process goes to the process of S46, and in the case of "YES", the process goes to the process of S47. In the case of "NO" in S45, the input signal is lowered with a decrement of 5% (S46). Then, the process goes to S42, and the step of detecting the time by the one rotation drive is repeated again (S42). In the case of "YES" in S45, the single rotation times of the respective duties are subjected to linear interpolation, so that a relationship between the duty and the single rotation time is obtained and then the duty with respect to the target supply time to is calculated (S47).

In the case where the above-described parts are typical parts and a fluctuation of the duty is 5% due to the fluctuation of the parts, there is a need to avoid that the supply is not in time, and therefore, in the case where the first input signal is made uniform, the input signal is set at 75% at which even a lower-limit product can be driven. For this reason, most of typical product and upper-limit product are excessively fast rotated, and therefore, the effect is small in the initial stage.

By carrying out the control of this embodiment, the initial rotation time can be optimized every hopper, so that a proper effect can be achieved from the initial stage.

<Sixth Embodiment>

Next, the Sixth Embodiment of the present invention will be specifically described. This embodiment is similar to the Fourth and Fifth Embodiments, and therefore, constituent elements are represented by the same reference numerals or symbols and will be omitted from detailed description.

In Fourth and Fifth Embodiments, even in the case where the DC motor is used, the developing speed can be brought near to the desired speed. However, in a region in which the motor input signal is low, there is a region in which the drive is unstable due to the motor performance and the fluctuation of the torque exerted on the motor, so that a degree of non-uniformity of the supply time becomes large. Further, in some cases, the supply cannot be carried out within a target time and thus the toner content in the developing device changes.

Such a range changes depending on tolerances of the supplying device such as the motor performance and the fluctuation of the torque resulting from the screw. When a use range of the input signal is narrowed, from the viewpoint of the control, safety is ensured, but a range in which the rotation time can be changed decreases. For this reason, in this embodiment, the use range of the input signal is optimized depending on the supplying device.

Similarly as in the supply in the Fifth Embodiment, before the toner is fed by the screw, i.e., before the toner bottle is placed or at timing when the motor and the screw are exchanged due to failure or the like, the single rotation time is detected while changing the input signal. At this time, for each of certain respective input signals, sampling is carried out 10 times, so that non-uniformity of the respective input signals is detected.

FIG. 18 shows a relationship between the input signal and a difference between a maximum and a minimum of the single rotation time in a state that the toner is not placed in the hopper in a typical supplying device. In FIG. 18, data is obtained with an increment of 5%-duty with respect to the input signal and remaining data is obtained through linear interpolation. An actual rotational speed varies depending on the fluctuation of the screw component parts. At each of the duties, sampling is made 10 times, and a difference between a maximum and a minimum is calculated.

Thus, on the basis of a result of a variation acquired for each hopper, a limit is provided so that the input signal value which is not less than a predetermined threshold is not used. In this embodiment, a various range used was 15 ms. As regards the hopper in FIG. 1, the use range was not less than 55%.

A flowchart of control will be described with reference to FIG. 19. A first input signal n is 100% and an execution number (of times) m is one (time) (S51). Drive is started at an input signal of n % (S52). One rotation is detected and a time from the drive start to the detection is acquired (S53). The drive is stopped immediately after the one rotation detection (S54). Whether or not the execution number m is 10 times is discriminated (S55), and in the case of "NO", the process goes to S52, and the detection is repeated until the execution number m reaches 10 times. When the execution number m is not less than 10 times, the discrimination in S55 is "YES", and the process goes to S56. In order to discriminate whether or not the region is a rotation to be used, whether or not the input signal is 40% is discriminated (S56). In the case of "NO", the process goes to the process of S57, and in the case of "YES", the process goes to the process of S58. In the case of "NO" in S56, the input signal is lowered with a decrement of 5% (S57). Then, the process goes to S52, and the step of detecting the time by the one rotation drive is repeated again (S53). In the case of "YES" in S56, a variation of the single rotation times of the respective duties is subjected to linear interpolation, so that a relationship between the duty and the variation of the single rotation time is obtained and then a duty threshold used is calculated (S58).

In the case where the above-described parts are typical parts and a fluctuation of the duty is 5% due to the fluctuation of the parts, there is a need to avoid that the drive is unstable, and therefore, in the case where the threshold is made uniform, the threshold is set at 60% at which even a lower-limit product is stably driven. For this reason, as regards most of typical product and upper-limit product, the slowest rotation time is limited. In the typical product, the single rotation time is limited to 1.07 s or less.

By carrying out the control of this embodiment, the initial rotation time can be optimized every hopper, so that a duty in a proper range for each of the hoppers can be used.

Incidentally, the materials of the photosensitive drum 1 used in the image forming apparatus 1, the developer and the constitution of the image forming apparatus 1 and the like in the above-described embodiments are not limited thereto, but the present invention is also applicable to various developers and image forming apparatuses. Specifically, the color of the toner, the number of colors, the order of development of the electrostatic latent images with the respective color toners, the number of linear speeds of the image forming apparatus 1, the time per rotation of the supplying screw 31 and the like are not limited to those in the above-described embodiments. Further, the temperature threshold of the change in rotation time of the supplying screw 31 is not limited to the temperature threshold in the Second Embodiment, but a plurality of temperature thresholds may also be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-134891 filed on Jul. 10, 2017, which is hereby incorporated by reference herein in its entirety.

What is claimed is:

1. An image forming apparatus capable of executing an image forming job for continuously forming images on a plurality of recording materials, said image forming apparatus comprising:

an image bearing member;

a developing device including a developer carrying member configured to carry a developer containing toner and a carrier to develop an electrostatic latent image formed on said image bearing member, a developer container accommodating the developer to be supplied to said developer carrying member, and a developer feeding portion configured to feed the developer accommodated in said developer container;

a supplying screw configured to supply developer to said developing device;

a driving device configured to rotationally drive said supplying screw; and a controller, wherein said controller is capable of executing an operation in a mode in which said controller controls said driving device, so that a rotational speed of said supplying screw when said supplying screw is rotated a predetermined number of times to supply the developer to said developing device in a predetermined amount during execution of an image forming job for continuously forming images on a plurality of first recording materials is a first rotational speed, and so that a rotational speed of said supplying screw when said supplying screw is rotated the predetermined number of times to supply the developer to said developing device in the predetermined amount during execution of an image forming job for continuously forming images on a plurality of second recording materials is a second rotational speed slower than the first rotational speed, and wherein the second recording materials have a length longer than a length of the first recording materials with respect to a sub-scan direction.

2. An image forming apparatus according to claim 1, wherein the length of the second recording materials with respect to the sub-scan direction is 420 mm.

3. An image forming apparatus according to claim 1, wherein the length of the second recording materials with respect to the sub-scan direction is 210 mm.

4. An image forming apparatus according to claim 1, further comprising a temperature sensor configured to detect an ambient temperature of said developing device, wherein said controller executes the operation in the mode when the ambient temperature of said developing device detected by said temperature sensor is a predetermined temperature or more.

5. An image forming apparatus according to claim 1, further comprising a temperature sensor provided in said developing device and configured to detect a temperature of the developer accommodated in said developer container, wherein said controller executes the operation in the mode when the temperature of the developer, accommodated in said developer container, detected by said temperature sensor is a predetermined temperature or more.

6. An image forming apparatus according to claim 1, wherein said controller sets the predetermined number of times on the basis of information on an amount of toner consumed by formation of the images on the plurality of recording materials by execution of the image forming job and on the basis of information on an amount of the developer supplied per rotation of said supplying screw to said developing device.

7. An image forming apparatus according to claim 1, further comprising a toner content sensor provided in said developing device and configured to detect information on a toner content as a ratio of the toner and the carrier of the developer accommodated in said developer container, wherein said controller sets the predetermined number of times on the basis of information on an amount of the toner consumed by formation of the images on the plurality of recording materials by execution of the image forming job, on the basis of information on an amount of the developer supplied per rotation of said supplying screw to said developing device, and on the basis of information on the toner content of the developer, accommodated in said developer container, detected by said toner content sensor.

8. An image forming apparatus according to claim 7, wherein said toner content sensor is an inductance sensor.

9. An image forming apparatus according to claim 1, further comprising a supply developer accommodating portion configured to accommodate the developer, wherein said supplying screw is provided in said supply developer accommodating portion and supplies the developer accommodated in said supply developer accommodating portion to said developing device.

10. An image forming apparatus according to claim 1, wherein said driving device is a stepping motor.

11. An image forming apparatus according to claim 1, wherein said driving device is a DC motor.

12. An image forming apparatus capable of executing an image forming job for continuously forming images on a plurality of recording materials, said image forming apparatus comprising:

an image bearing member;

a developing device including a developer carrying member configured to carry a developer containing toner and a carrier to develop an electrostatic latent image formed on said image bearing member, a developer container accommodating the developer to be supplied to said developer carrying member, and a developer feeding portion configured to feed the developer accommodated in said developer container;

a supplying screw configured to supply developer to said developing device;

a driving device configured to rotationally drive said supplying screw; and a controller, wherein said controller is capable of executing an operation in a mode in which said controller controls said driving device, so that a rotational speed of said supplying screw when said supplying screw is rotated a predetermined number of times to supply the developer to said developing device in a predetermined amount during execution of an image forming job for continuously forming images on a plurality of A4-size recording materials is a first rotational speed, and so that a rotational speed of said supplying screw when said supplying screw is rotated the predetermined number of times to supply the developer to said developing device in the predetermined amount during execution of an image forming job for continuously forming images on a plurality of A3-size recording materials is a second rotational speed slower than the first rotational speed.

13. An image forming apparatus according to claim 12, further comprising a temperature sensor configured to detect an ambient temperature of said developing device, wherein said controller executes the operation in the mode when the ambient temperature of said developing device detected by said temperature sensor is a predetermined temperature or more.

14. An image forming apparatus according to claim 12, further comprising a temperature sensor provided in said developing device and configured to detect a temperature of the developer accommodated in said developer container, wherein said controller executes the operation in the mode when the temperature of the developer, accommodated in said developer container, detected by said temperature sensor is a predetermined temperature or more.

15. An image forming apparatus according to claim 12, wherein said controller sets the predetermined number of times on the basis of information on an amount of the toner consumed by formation of the images on the plurality of recording materials by execution of the image forming job and on the basis of information on an amount of the developer supplied per rotation of said supplying screw to said developing device.

16. An image forming apparatus according to claim 12, further comprising a toner content sensor provided in said developing device and configured to detect information on a toner content as a ratio of the toner and the carrier of the developer accommodated in said developer container, wherein said controller sets the predetermined number of times on the basis of information on an amount of the toner consumed by formation of the images on the plurality of recording materials by execution of the image forming job, on the basis of information on an amount of the developer supplied per rotation of said supplying screw to said developing device, and on the basis of information on the toner content of the developer, accommodated in said developer container, detected by said toner content sensor.

17. An image forming apparatus according to claim 16, wherein said toner content sensor is an inductance sensor.

18. An image forming apparatus according to claim 12, further comprising a supply developer accommodating portion configured to accommodate the developer, wherein said supplying screw is provided in said supply developer accommodating portion and supplies the developer accommodated in said supply developer accommodating portion to said developing device.

19. An image forming apparatus according to claim 12, wherein said driving device is a stepping motor.

20. An image forming apparatus according to claim 12, wherein said driving device is a DC motor.

* * * * *